US012599804B2

(12) United States Patent
Nørgaard Johansen et al.

(10) Patent No.: US 12,599,804 B2
(45) Date of Patent: Apr. 14, 2026

(54) WEIGHT LIFTING MACHINE

(71) Applicant: Kompan A/S, Odense SØ (DK)

(72) Inventors: Martin Nørgaard Johansen, Odense SØ (DK); Jakob Jensen, Odense SØ (DK)

(73) Assignee: Kompan A/S, Odense SØ (DK)

( * ) Notice: Subject to any disclaimer, the term of this patent is extended or adjusted under 35 U.S.C. 154(b) by 136 days.

(21) Appl. No.: 18/557,896

(22) PCT Filed: Apr. 27, 2022

(86) PCT No.: PCT/EP2022/061172

§ 371 (c)(1),
(2) Date: Oct. 27, 2023

(87) PCT Pub. No.: WO2022/229249

PCT Pub. Date: Nov. 3, 2022

(65) Prior Publication Data

US 2024/0216744 A1 Jul. 4, 2024

(30) Foreign Application Priority Data

Apr. 28, 2021 (DK) ..... PA202170194
Sep. 26, 2021 (DK) ..... PA202170467

(51) Int. Cl.
*A63B 21/062* (2006.01)
*A63B 21/00* (2006.01)
*A63B 71/00* (2006.01)

(52) U.S. Cl.
CPC ..... *A63B 21/063* (2015.10); *A63B 21/154* (2013.01); *A63B 21/4047* (2015.10); *A63B 2071/009* (2013.01); *A63B 2208/0233* (2013.01)

(58) Field of Classification Search
CPC ..... A63B 21/0615; A63B 21/0616; A63B 21/0617; A63B 21/063; A63B 21/4047; A63B 21/154
See application file for complete search history.

(56) References Cited

U.S. PATENT DOCUMENTS 4,546,971 A * 10/1985 Raasoch ..... A63B 21/063 482/137
4,953,855 A * 9/1990 Shields ..... A63B 21/0628 482/99

(Continued)

FOREIGN PATENT DOCUMENTS

CN 108339223 A 7/2018
CN 108905055 A 11/2018

(Continued)

OTHER PUBLICATIONS

Search Report and Written Opinion issued in International Application No. PCT/EP2022/061172, mailed Aug. 31, 2022.

(Continued)

*Primary Examiner* — Zachary T Moore
(74) *Attorney, Agent, or Firm* — Bookoff McAndrews, PLLC

(57) ABSTRACT

Weight lifting machine includes adjustable weight assembly having a plurality of individual weights, a weight displacement mechanism which displaces one or more of the weights in a direction against a resistive force and a weight selection mechanism arranged to selectively engage one or more of the individual weights with said weight displacement mechanism. A handle applies a force to a horizontal bar connected to the handle which is connected to the weight displacement to move the weight displacement mechanism. The weight assembly further comprises a housing enclosing the individual weights, the weight displacement mechanism and the weight selection mechanism such that a user is (Continued)

prevented from coming into contact with any moving parts arranged in the housing and a displaceable selector handle arranged on an outer portion of the housing and arranged to operate the weight selection mechanism. Furthermore, the horizontal bar is arranged outside the housing.

16 Claims, 17 Drawing Sheets

(56) References Cited

U.S. PATENT DOCUMENTS

| | | | | |
|---|---|---|---|---|
| 6,599,223 | B2 * | 7/2003 | Wang | A63B 21/005 482/4 |
| D516,143 | S * | 2/2006 | Panatta | D21/676 |
| 7,614,981 | B2 | 11/2009 | Cao | |
| 11,229,822 | B1 * | 1/2022 | Manula | A63B 21/4047 |
| D952,072 | S * | 5/2022 | Horita | D21/690 |
| 2008/0300116 | A1 * | 12/2008 | Eder | A63B 21/063 482/100 |
| 2022/0288447 | A1 * | 9/2022 | Spurgin | A63B 21/00069 |

FOREIGN PATENT DOCUMENTS

| | | | |
|---|---|---|---|
| FR | 2613237 | A1 | 10/1988 |
| KR | 102139193 | B1 | 7/2020 |
| KR | 20210003504 | A | 1/2021 |
| WO | 9853885 | A1 | 12/1998 |
| WO | 2006065954 | A2 | 6/2006 |
| WO | 2007011433 | A2 | 1/2007 |
| WO | 2009100715 | A2 | 8/2009 |
| WO | 2010104463 | A1 | 9/2010 |
| WO | 2011123716 | A1 | 10/2011 |
| WO | 2014163340 | A2 | 10/2014 |
| WO | 2015124065 | A1 | 8/2015 |
| WO | 2021012366 | A1 | 1/2021 |

OTHER PUBLICATIONS

Search Report issued in Denmark Application No. PA 2021 70194, issued on Oct. 21, 2021.

* cited by examiner

WEIGHT LIFTING MACHINE

CROSS-REFERENCE TO RELATED APPLICATIONS

This is a National Stage Application under 35 U.S.C. § 371 of International Application No. PCT/EP2022/061172, filed on Apr. 27, 2022, now published as WO 2022/229249 A1, which claims priority to Denmark Patent Application No. PA202170467, filed on Sep. 26, 2021, and Denmark Patent Application No. PA202170194, filed on Apr. 28, 2021.

TECHNICAL FIELD OF THE INVENTION

The current invention relates to a weight lifting machine comprising: an adjustable weight assembly and a user force input assembly. The adjustable weight assembly comprises a plurality of individual weights, a weight displacement mechanism which displaces one or more of the plurality of individual weights in a direction against a resistive force and a weight selection mechanism arranged to selectively engage one or more of said plurality of individual weights with said weight displacement mechanism. The user force input assembly comprises a handle or other user force input device suitable for a user to apply force to and a horizontal bar connected to the handle or other user force input device, said horizontal bar being arranged to pivot about a horizontal axis and being connected to the weight displacement mechanism such that motion of the handle or other user force input device results in motion of the weight displacement mechanism. The invention also relates to an arrangement of two or more weight lifting machines where at least two of the weight lifting machines have different functions but where the adjustable weight assemblies of the two weight lifting machines are essentially the same.

BACKGROUND OF THE INVENTION

Weight lifting machines are well known in the art of fitness training machines. Weight lifting machines are typically setup in a fitness gym and typically have a set of weights which the user can selectively engage with a handle or other user input device. By selecting different weights, the user can vary the force required to lift the weights. Once a set of weights is engaged with the user input device, the user can then manipulate the weights via the user input device. The weights are typically arranged as a stack of metal plates which the user can selectively engage with or disengage from a lifting rod via a pin which can be removably inserted into the metal plates and lifting rod. When changing the desired amount of weight, the user removes the pin from a hole in one metal plate and places the pin in another hole in another metal plate. The further down the pin is set in the stack, the greater the number of plates which the user needs to lift.

While this known mechanism is simple and relatively easy to operate, there are a number of drawbacks as well. There is a risk that the pin gets lost if a user removes the pin without putting it back in the mechanism. Losing the pin would render the mechanism inoperable. Likewise, if the user doesn't engage the pin properly with the mechanism, there is a risk that the weights are released in an undesired manner. This can have significant safety risks for the user, as well as for the equipment itself.

In addition, some users find the process of removing the pin and then reinserting the pin in another plate complicated.

This is especially true for the lower most plates in the stack which can be difficult to reach. Furthermore, the most commonly available mechanisms today can be "jammed" if the user inserts a pin into the mechanism while the lifting rod is lifted with no weights attached. Once it is jammed, the mechanism is prevented from being lifted completely.

Different mechanisms have previously been proposed which provide a system which should be easier to use for the user. Some prior art examples of more advanced mechanisms for weight selection are disclosed in FR2613237, U.S. Pat. No. 7,614,981, WO2009100715, WO2010104463, WO2007011433, WO2015124065 and WO9853885. These systems have not been widely adopted as the complexity and added costs have been too great when compared with the typical removable pin system.

Another issue with the prior art mechanisms is that since the user is engaging the pin directly with the plates of the weight stack, the weight stack needs to be accessible to the user. This creates safety risks since the user or another bystander could put hands/limbs into the mechanism by mistake. As currently available weight lifting machines are typically used in controlled, indoor and supervised fitness environments, it can be assumed that the users and the other people around the machines are trained in their use. However, it is not possible to use currently available fitness machines outside in non-controlled and unsupervised environments, due to the abovementioned safety risks. For example, in an outdoor environment, it cannot be prevented that two small children will operate the equipment in an unsupervised manner with the resulting risk of injury to them. In outside and unsupervised environments, there is also a risk of vandalism, exposure to potentially harsh outdoor environment and increased cost of maintenance.

SUMMARY OF THE INVENTION

It is therefore a first aspect of the current invention to provide a weight lifting machine which is more suitable for outdoor and/or unsupervised use than prior art machines.

A second aspect is to provide a weight lifting machine which is safer than prior art type machines.

A third aspect is to provide a weight lifting machine where it is easy for a user to change the selected weight.

A fourth aspect is to provide an adjustable weight assembly which can be used in different types of fitness machines in a simple manner without the need for complicated reconfiguration.

At least some of the above mentioned aspects are solved by a weight lifting machine as described in claim 1. In this way, a safe and robust weight lifting machine is provided which is suitable for use in outdoor and/or unsupervised environments.

In some embodiments, the displaceable selector handle is a rotationally arranged handle, which is rotated by a user to operate the weight selection mechanism. This provides an intuitive and easy to operate selector which is in a constant position and is therefore easy to reach.

In some embodiments, the handle or other user force input device and the horizontal bar form a single unit where the positional relationship between the handle or the other user force input device and the horizontal bar is constant. In this way, the user or a bystander cannot get any limbs caught in the machine. In some embodiments, the weight lifting machine does not comprise any moving parts which are connected to the individual weights and are arranged outside the housing other than the user force input assembly.

In some embodiments, the plurality of individual weights is in the form of a vertically arranged stack of weight plates and the weight displacement mechanism comprises a rotational to linear translation mechanism, said rotational to linear translation mechanism being connected between the horizontal bar and the plurality of individual weights, such that when the user force input assembly is moved by the user, the horizontal bar rotates and the weights move up or down, depending on the direction of motion of the user force input assembly. In other embodiments, the plurality of individual weights is in the form of a series of vertically arranged weight plates in a side by side configuration, said weight plates being moved up and down by the weight displacement mechanism. In other embodiments, the plurality of individual weights is in the form of weights arranged at the end of lever arms, said weight displacement mechanism rotating the weights via the lever arms.

In some embodiments, each of the plurality of weight plates in the stack of weight plates is provided with a vertically arranged through-going hole in the top surface of the weight plates, the vertically arranged through-going holes of the plurality of weight plates are aligned along a vertical axis, the weight selection mechanism comprises a vertically arranged rod which is arranged to enter the vertically arranged through-going holes in the weight plates and each weight plate is provided with an engagement mechanism having two positions, an engaged position and a disengaged position where the weight plate is engaged with the vertically arranged rod in the engaged position and disengaged from the vertically arranged rod in the disengaged position.

In some embodiments, the weight selection mechanism comprises a vertically displaceable trolley which moves along a vertical axis in response to the motion of the selector handle and in that the vertically displaceable trolley actuates the engagement mechanisms of the weight plates as the trolley passes the weight plates.

In some embodiments, the weight selection mechanism comprises a plurality of pins, each pin being associated with one weight plate and being arranged displaceably in a hole in the weight plate, each of said pins having a first engaged position and a second disengaged position, where the pin in its engaged position is pushed into the weight plate such that it engages a hole in the vertically arranged rod and in the disengaged position, the pin is retracted in the weight plate so that it is not engaged with the vertically arranged rod. This provides a very simple mechanism which is robust, safe and not so expensive.

In some embodiments the trolley pushes the pins into their engaged position when the trolley moves downwardly past the pin and pulls the pin into its disengaged position when the trolley moves upwardly past the pin In some embodiments, the weight selection mechanism comprises a pin stabilization mechanism which keeps the pins below the trolley from moving inwardly. In some embodiments, the pin stabilizing mechanism comprises a vertically elongated member which is connected between the wagon and the base of the machine and which is arranged between the end of the pins and the weight stack. In some embodiments, the pins have a protrusion extending from the pin, said vertically elongated member being arranged between the protrusions on the pins and the weight stack. In some embodiments, the vertically elongated member is an extendible member which constantly adjusts its length to fit between the bottom of the weight stack and the trolley. In one embodiment, the vertically elongated member is a rolled up band. In one embodiment, the rolled up band is slightly curved in a cross section taken on a plane perpendicular to the extension of the vertically elongated member.

In some embodiments, the weight selection mechanism comprises a first safety mechanism for preventing adjustment of the weight selection mechanism when one or more of the plurality of weights are displaced away from their resting position and/or a second safety mechanism for preventing displacement of the weight displacement mechanism during operation of the weight selection mechanism.

In some embodiments, the weight selector handle is rotated about its central axis to operate the weight selection mechanism.

In some embodiments, the weight stack assembly includes an indexing mechanism having a plurality of holes arrayed circularly around a periphery of a toothed wheel attached to the weight selector handle and a pin adapted for insertion inside one of the plurality of holes.

In some embodiments, the weight selector handle is pulled outwardly to disengage the pin from the hole to enable the rotation of the weight selector handle.

In some embodiments, the first safety mechanism includes a rotatable rod adapted to be rotated about its central axis in response to a linear movement of the selector handle and a lever engaged to the rod and adapted to pivot in response to the rotation of the rod. In some embodiments, the lever includes a vertical flange arranged to contact a plate spring which is displaced between two positions by the vertically arranged rod to prevent a rotation of the rotatable rod when the vertically arranged rod is lifted and hence prevent pulling of the weight selector handle outwardly.

In some embodiments, the pin stabilization mechanism includes a snap mechanism which holds the pin in a stable position in the disengaged position of the pin. In some embodiments, the snap mechanism includes a clip attached to the pin, said clip having a bendable locking flange which is engaged with a snap edge of a weight plate in the disengaged position of the pin. In some embodiments, the snap mechanism comprises a clip attached to the weight plate and the locking flange having a vertical skirt adapted to engage with the clip in the disengaged position of the pin to keep the pin from moving inwardly.

The current specification also discloses a weight lifting machine arrangement comprising a first weight lifting machine as described in one of the embodiments above and a second weight lifting machine according to one of the embodiments above, and where the vertical distance from the ground to the horizontal bar of the first machine is greater than the vertical distance from the ground to the horizontal bar of the second machine. In this way, a system of weight lifting machines is provided where different types of machines can be provided, with different functions, but where the main weight arrangement is essentially the same. This reduces the costs of manufacturing such a system, since there will be more common components. This is especially important for outdoor machines as these will be made from more expensive materials and heavier materials. Hence, outdoor machines are typically more expensive than indoor machines and as such, simplifying the construction and assembly of the machines can have a great effect on the total cost. In one embodiment, the plurality of individual weights, the weight selection mechanism, the weight displacement mechanism and the displaceable selector handle of the first and second machine are essentially the same.

In one embodiment, the weight displacement mechanism of the first and second machines both comprise a first wire or belt connected to a lever arm which is pivoted by the horizontal bar. In one embodiment, the wire or belt is arranged to drive a first pulley wheel attached to a frame of the weight lifting machine when the lever arm is pivoted. In one embodiment, the first pulley wheel is arranged to drive a second pulley wheel which is larger than the first pulley wheel. In one embodiment, the machine further comprises a second wire or belt connecting the second pulley and the elongated rod of the weight selection mechanism via a third pulley wheel arranged at the upper portion of the housing. In one embodiment, the first and second wires or belts are both parts of the same wire or belt. In one embodiment, the lever arm and/or the first pulley wheel and/or the second pulley wheel are pivotably fastened to a frame of the weight lifting machine via a one or more brackets which is/are bolted to the frame of the weight lifting machine. In one embodiment of the weight lifting machine arrangement, the first machine and the second machine, both have the same frame, each frame having mounting holes suitable for mounting the brackets of the lever arm, the first and/or the second pulley wheel in a first location and a second different location. In this way, the same basic mechanism can be used in two different weight lifting machines having two different locations of the horizontal bar, thereby allowing different weight lifting functions to be realized by placing the horizontal bar in different locations.

It should be noted that the current specification discloses some different and unique weight selection mechanisms arranged inside the housing. Claim 1 is directed to the overall machine with the housing and the weight selection mechanism arranged inside the housing. However, it should be clear that the different features of the weight selection mechanism disclosed could form the basis of a related divisional application with claims directed to the novel and inventive weight selection mechanism, without being limited to being arranged inside a housing. This could for example take the form of an independent claim with the following wording:

Weight lifting machine comprising a plurality of individual weights in the form of a vertically arranged stack of horizontally arranged weight plates and a weight selection mechanism, where each of the plurality of weight plates in the stack of weight plates is provided with a vertically arranged through-going hole in the top surface of the weight plates, in that the vertically arranged through-going holes of the plurality of weight plates are aligned along a vertical axis and in that the weight selection mechanism comprises a vertically arranged rod which is arranged to enter the vertically arranged through-going holes in the weight plates and in that each weight plate is provided with an engagement mechanism having two positions, an engaged position and a disengaged position where the weight plate is engaged with the vertically arranged rod in the engaged position and disengaged from the vertically arranged rod in the disengaged position. Additional features could be provided by the features described in this specification as being related to the weight selection mechanism. This could include the two safety mechanisms described herein. Some specific claims are current claims 5-9 when dependent on the proposed claim above instead of current claim 4.

It should be emphasized that the term "comprises/comprising/comprised of" when used in this specification is taken to specify the presence of stated features, integers, steps or components but does not preclude the presence or addition of one or more other features, integers, steps, components or groups thereof.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

Figure 1:
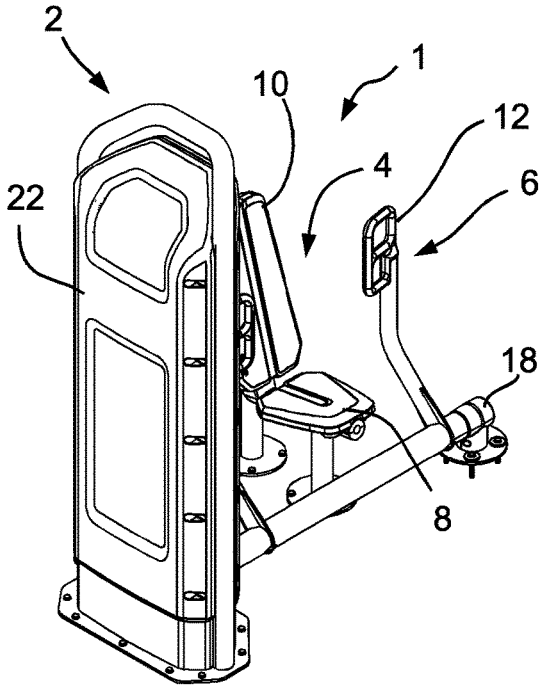
FIG. 1 shows a top left perspective view of a chest press weight lifting machine in a neutral position.
Figure 2:
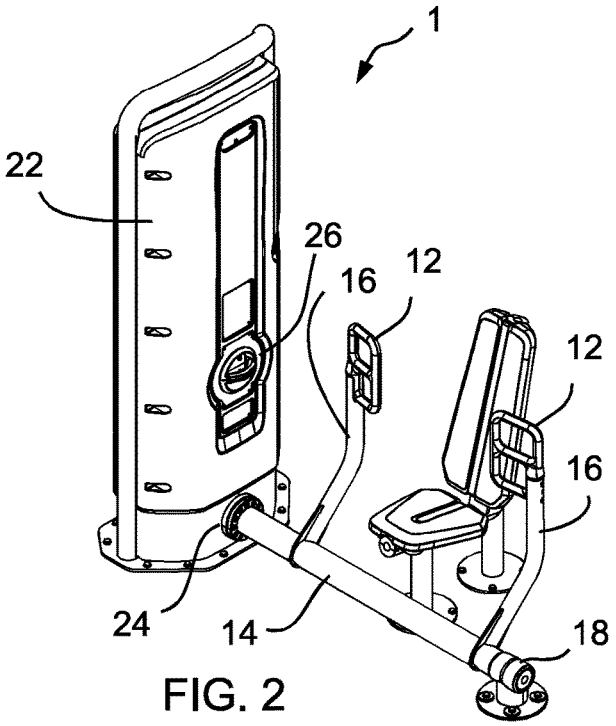
FIG. 2 shows a top right perspective view of the weight lifting machine of FIG. 1.
Figure 3:
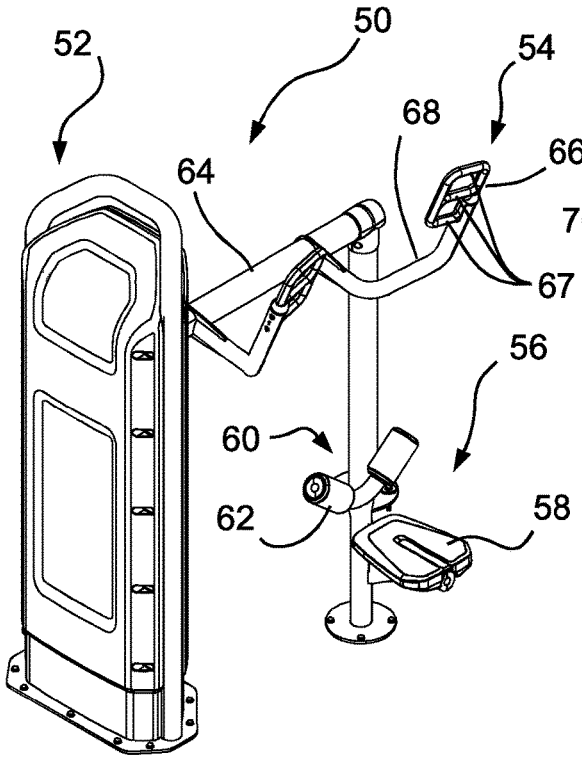
FIG. 3 shows a top left perspective view of a lat pulldown weight lifting machine in a neutral position.
Figure 4:
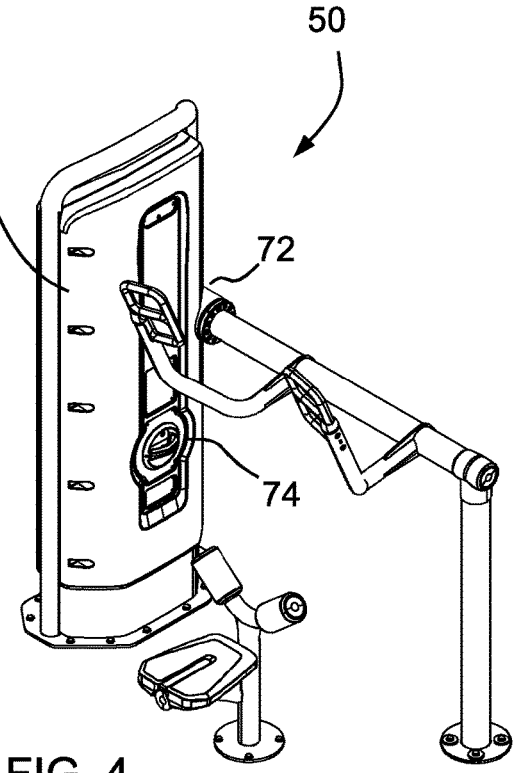
FIG. 4 shows a top right perspective view of the weight lifting machine of FIG. 3.

FIGS. 1, 2, 5 and 6 show different views of a weight lifting machine in the form of a seated chest press weight lifting machine 1. The machine is arranged with an adjustable weight stack assembly 2, a seat assembly 4 and a handle assembly 6. The user sits on the seat 8 with their back against the back-rest 10 and holds onto the handles 12 of the handle assembly. During the fitness activity, the user pushes the handles 12 outwardly against the weight selected in the weight stack assembly. When the user relaxes, the weights selected in the weight stack assembly will push the handles back towards the user. The function of a seated chest press machine will not be discussed further here since the person skilled in the art of fitness machines will understand the basic functionality.

The handle assembly 6 comprises two handles 12, a horizontally arranged bar 14 and two vertically arranged bars 16 which connect the horizontally arranged bar 14 and the handles 12. The handles 12, horizontal bar 14 and vertical bars 16 form a single fixed unit where the separate parts do not move relative to each other, but move as a single unit. Hence, there is no risk that a person's hands or other limbs can get caught between two moving components of the handle assembly.

The horizontal bar is pivotably arranged between the weight stack assembly and an anchor portion 18 which is mounted to the ground. In another embodiment (not shown), the end of the horizontal bar opposite to the weight stack assembly could be arranged free floating if the connection between the weight stack assembly and the horizontal bar was strong enough. However, by providing an anchor portion 18 opposite to the weight stack assembly, the overall strength and robustness of the construction is improved. This is especially true in an outdoor environment where it can be expected that users will mishandle the equipment and children will climb on the equipment.

The weight stack assembly 2 has a housing 22 which covers all the moving parts of the weight stack assembly. The interior of the weight stack assembly is described in more detail with regards to FIGS. 11 to 22 later on. The housing has an opening 24 near the bottom of the weight stack assembly through which the horizontal bar 14 passes to engage with the moving parts inside the housing. The housing furthermore has a weight selector handle 26 which is rotated by the user to select how much weight is to be engaged in the weight stack. The weight selection mechanism will be described in more detail later on. It is to be noted that the weight stack assembly has multiple safety mechanisms to ensure the user's and the equipment's safety. A first safety mechanism prevents the weight selector handle 26 from being rotated when the weight stack has been lifted up. A second safety mechanism prevents the weight stack from being lifted up while the selector handle is being rotated. These safety mechanisms are described in more detail later on in this specification.

Due to the arrangement of the weight stack assembly and the handle assembly, the only moving part to which the user is exposed is the handle assembly itself. There are no parts between which the user or other bystander could get their hands or other limbs caught. Furthermore, there are no loose parts which can be lost or removed from the machine. Likewise, the machine is very robust to vandalism and the housing protects the mechanisms from the harsh outdoor environment.

Figure 5:
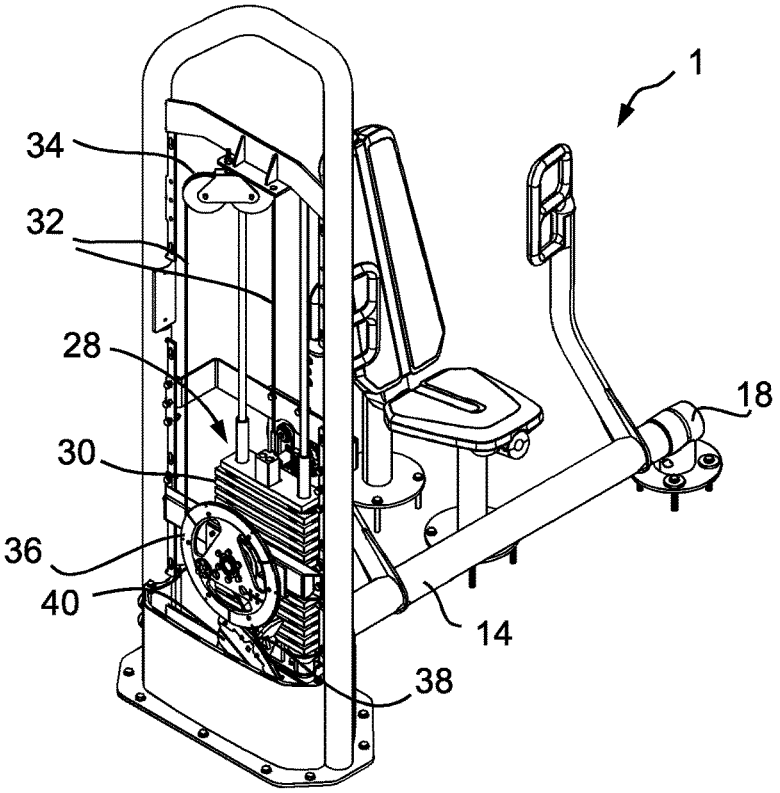
FIGS. 5 and 6 show top left and top right perspective views respectively of the weight lifting machine of FIG. 1 in a neutral position and with the housing partially removed to show the details of the weight stack.
Figure 6:
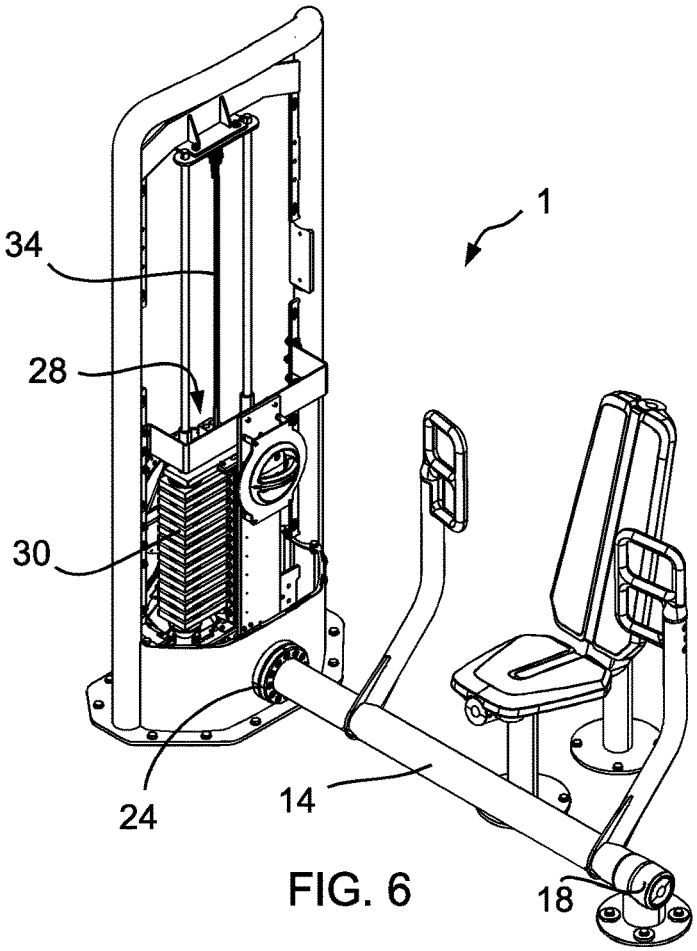

FIGS. 5 and 6 show the machine with the housing removed. More details will be provided later on with regards to FIGS. 11-22 however in general, the adjustable weight assembly comprises a stack 28 of weight plates 30. A weight selection mechanism selectively couples different numbers of weight plates to a wire 32. A first portion of the wire 32 runs from the weight stack up and over a pulley 34 and then down to a wheel 36. The first portion of the wire 32 is connected to an outer portion of the wheel 36. A second portion of the wire 38 is connected to an inner portion of the wheel and to an outer portion of a lever arm 40. In the current embodiment a single wire is used, however, two separate wires could be used in another embodiment.

The lever arm 40 is connected to the horizontal bar 14 and when the horizontal bar is rotated, the lever arm also rotates. This applies tension to the second portion of the wire which turns the wheel, which thereby causes the selected weight plates in the weight stack to lift. Due to the difference in radius of the attachment points of the two wires portions on the wheel, a gearing effect is provided. In this way, the distance travelled by the handles and the distance travelled by the weight stack can be adjusted to fit the machine and in one embodiment, the motion is adjusted so that the weight stack moves essentially the same distance as the handles. This provides a good feeling to the user.

FIGS. 3, 4, 7, 8, 9 and 10 show different views of a second weight lifting machine, this time in the form of a lat pull down weight lifting machine 50. As with the chest press machine, it is expected that the person skilled in the art of lat pull down machines is familiar with the function of a lat pull down machine and it will not be described in detail here.

The machine again comprises a weight stack assembly 52, a handle assembly 54 and a seat assembly 56. The seat assembly in this case comprises a seat portion 58 and a leg portion 60. The user can sit on the seat facing the leg portion and arrange his or her legs under the cushions 62 of the leg portion. The user is then supported against upwards lifting forces and can therefore apply greater forces on the handle assembly without being lifted up. It is to be noted that in typical leg portions of lat pull down machines, the cushions are arranged horizontally. However, by arranging the cushions at an angle, like in this embodiment, a greater variety of users can be accommodated without having to adjust the leg portion.

The handle assembly again comprises a horizontal bar 64, two handles 66 and two elongated arms 68 which connect the handles and the horizontal bar. As with the previous embodiment, the handle assembly forms a single unit without parts which move relative to each other. When the user pulls the handles down, the horizontal bar rotates. As in the previous embodiment, the horizontal bar 64 is supported on one side by the weight stack assembly 52 and on the other side by a ground anchor 69. In this case, due to the higher position of the horizontal bar, the ground anchor is also arranged as a vertically arranged post which supports the end of the horizontal bar opposite the weight stack assembly.

In both this embodiment and in the previous embodiment, the handles 12, 66 are formed with multiple holding portions. In this embodiment, each handle comprises three separate horizontal holding portions 67. In this way, users of different heights can use the same machine and hold onto different holding portions. In prior art type weight lifting machines, the seat portion is typically provided with a height adjustment mechanism to adjust the assembly to different users. However, by providing a handle with multiple holding portions, a much more simple machine is provided with a reduction in moving parts. This decreases the price of the machine, increases the simplicity and robustness of the machine and reduces the risk of injury to the user due to catching body parts between moving parts of an adjustment mechanism.

The adjustable weight assembly of this embodiment 50 again comprises a housing 70 which completely encloses the moving parts inside the weight assembly. An opening 72 in the housing is provided through which the horizontal bar enters the housing and moves the mechanism inside the housing. As in the previous embodiment, a weight selector handle 74 is provided which when rotated, chooses different weights. By comparing the two machines 1 and 50, it can be seen that for the most part, except for the location of the horizontal bar and its entry point into the housing, the adjustable weight assembly is essentially identical. This gives a uniform appearance to the different machines in this series of products as well as reduces the number of variants significantly. This reduces the cost of the machine as the number of similar parts can be increased which reduces stock and variant cost.

From FIGS. 7-10, it can be seen that the basic mechanism inside the weight stack assembly is essentially the same as for the chest press machine 1 from FIGS. 1, 2, 5 and 6. The only difference is the placement of the horizontal bar 64, the placement of the wheel 76 and the placement of the lever arm 78, all of which are higher up when compared to the chest press machine 1. However, the other components are the same and the functionality is the same. It can be seen that the wheel and the lever arm are mounted to brackets 80, 82 which are bolted to the frame 84 of the weight stack assembly. The frame 84 is prepared for different mounting brackets via preprepared mounting holes 86. In this way, the same basic weight stack assembly can be adapted to many different types of weight lifting machines, just by adjusting the positions of the horizontal bar, the wheel and the lever arm. Likewise, the point of connection between the wires and the wheel will also be able to be tuned to fit the specific machine and the desired motion.

Figure 7:
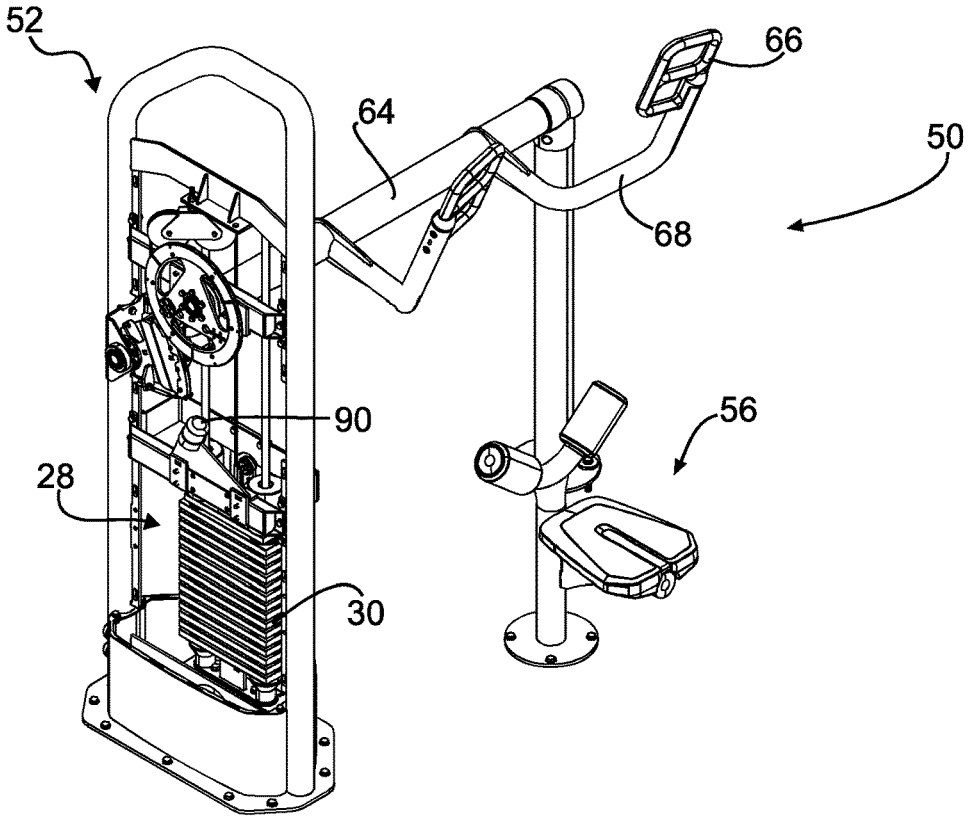
FIGS. 7 and 8 show top left and top right perspective views respectively of the weight lifting machine of FIG. 3 in a neutral position and with the housing partially removed to show the details of the weight stack.
Figure 8:
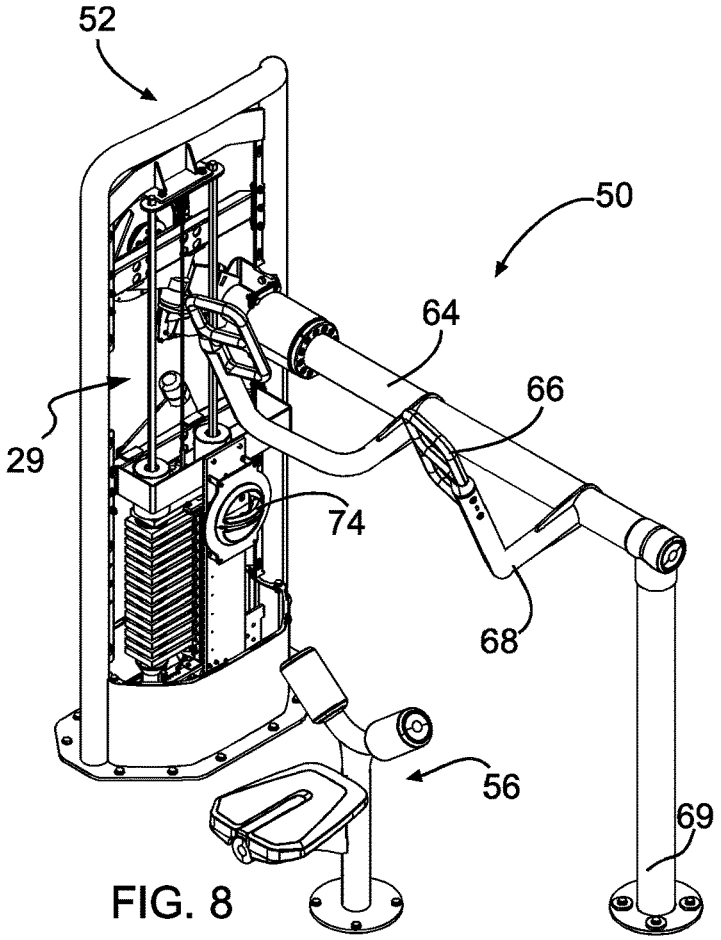
Figure 9:
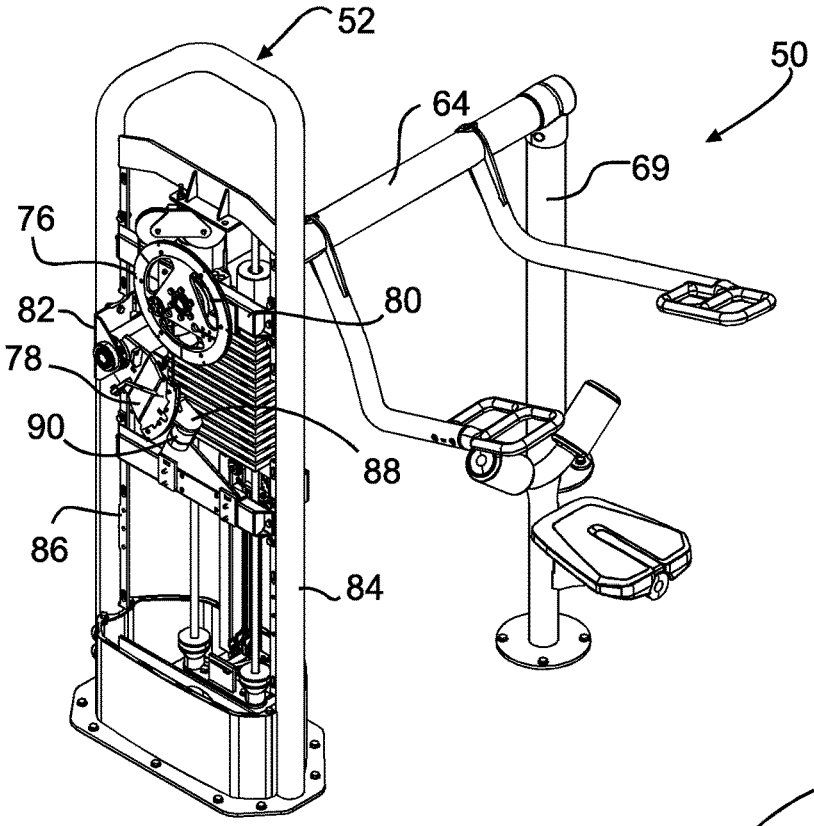
FIGS. 9 and 10 show top left and top right perspective views respectively of the weight lifting machine of FIG. 3 in a position where weight stack has been lifted and with the housing partially removed to show the details of the weight stack.
Figure 10:
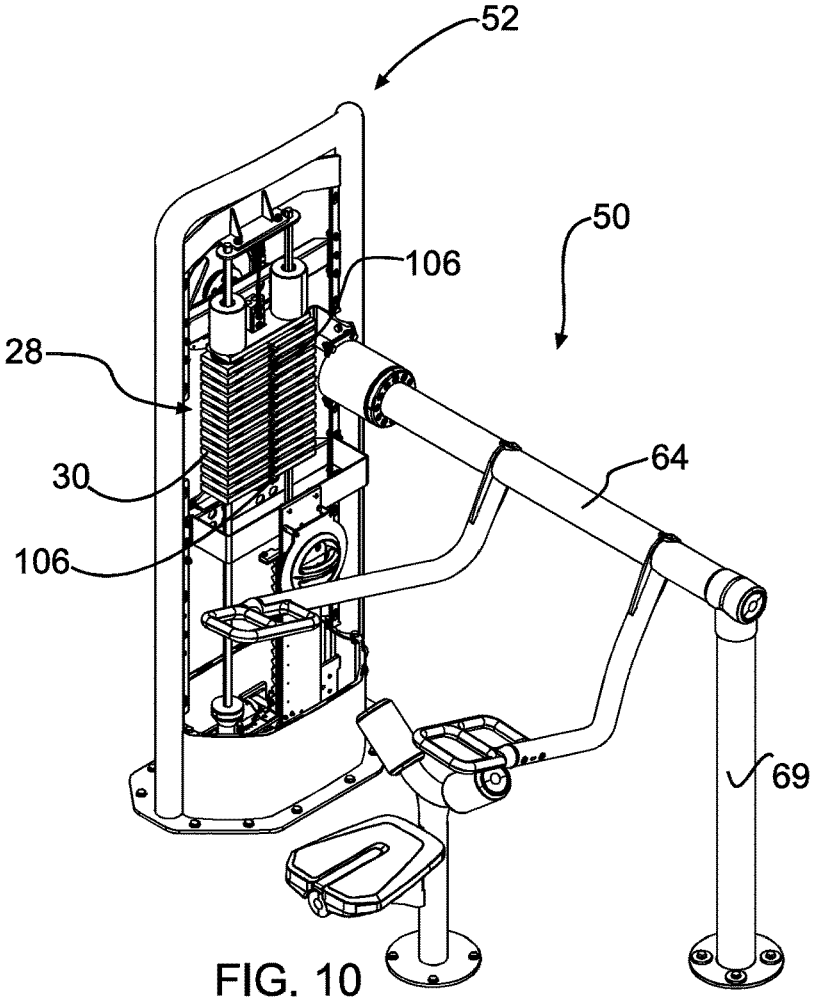

FIGS. 7 and 8 show the machine with the handles in the neutral position and the weight stack at its lowest position, while FIGS. 9 and 10 show the machine with the handles pulled down and the weight stack in its upper position. It should be clear that the position shown in FIGS. 9 and 10 can only be achieved by a user pulling down on the handles. In FIG. 9, it can be seen that the lever arm 78 has a protrusion 88 which engages with an end stop 90 attached to the frame. In this way, the motion of the machine is stopped at a predefined position when the protrusion on the lever arm reaches the end stop on the frame.

In FIGS. 11-18, the function of the mechanism of the weight stack assembly is described in more detail via different views of the mechanism. In different views, different components have been removed to show components located behind other components.

FIGS. 11-18 shows the weight stack assembly from FIG. 1 with a single weight plate 30 in the lifted position. This is the situation which occurs when the weight selection mechanism engages a single plate and then the user activates the handle assembly to lift the weight.

In this position, a first safety mechanism has been engaged which prevents the selector handle 26 from being rotated. This first safety mechanism will be described in more detail below.

Figure 11:
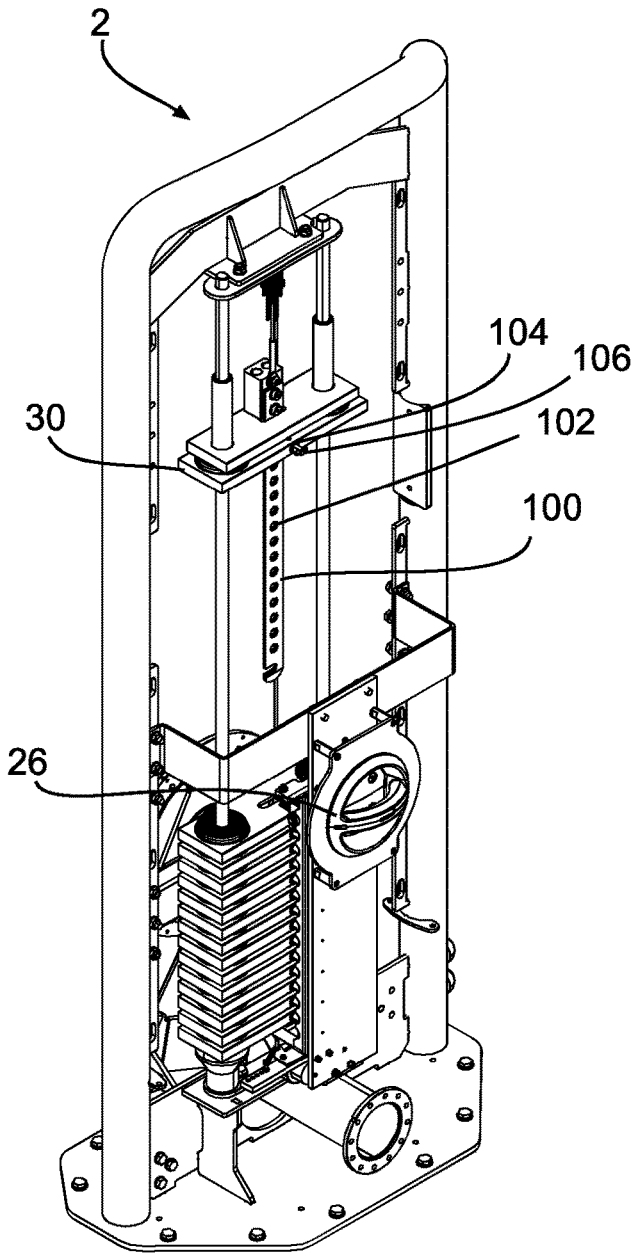
FIG. 11 shows a front perspective view of the weight stack of the machine of FIG. 1 in a position where one of the weight plates has been lifted and with the housing removed to show the internal details of the mechanism.
Figure 12:
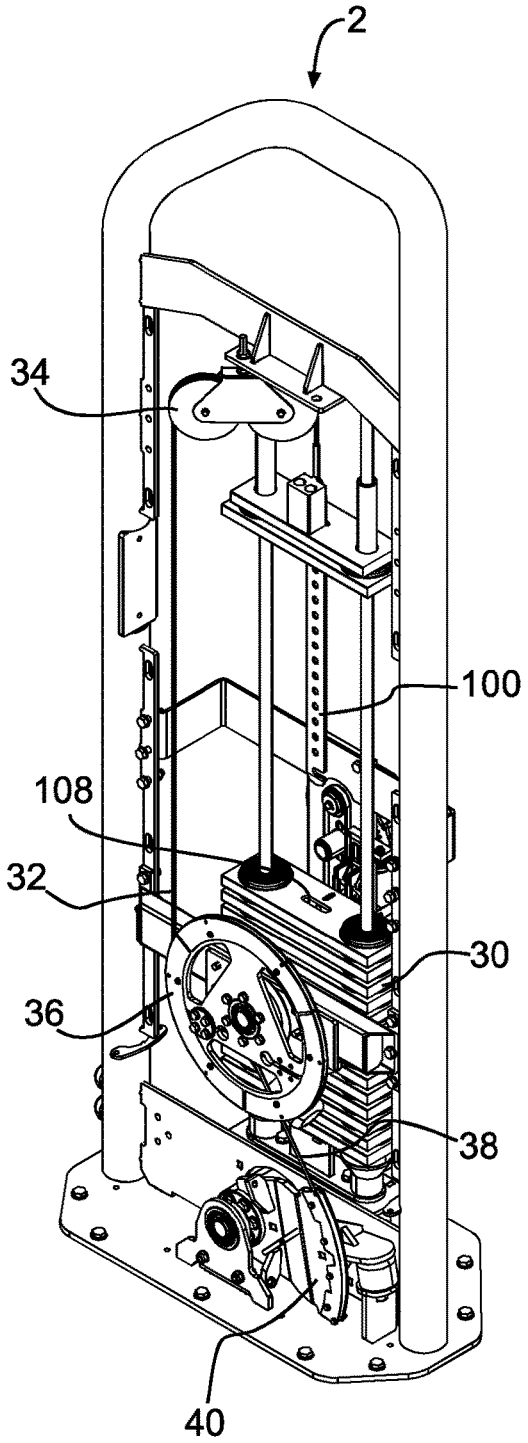
FIG. 12 shows a rear perspective view of the weight stack of the machine of FIG. 1 in a position where one of the weight plates has been lifted with the housing removed to show the internal details of the mechanism.
Figure 13:
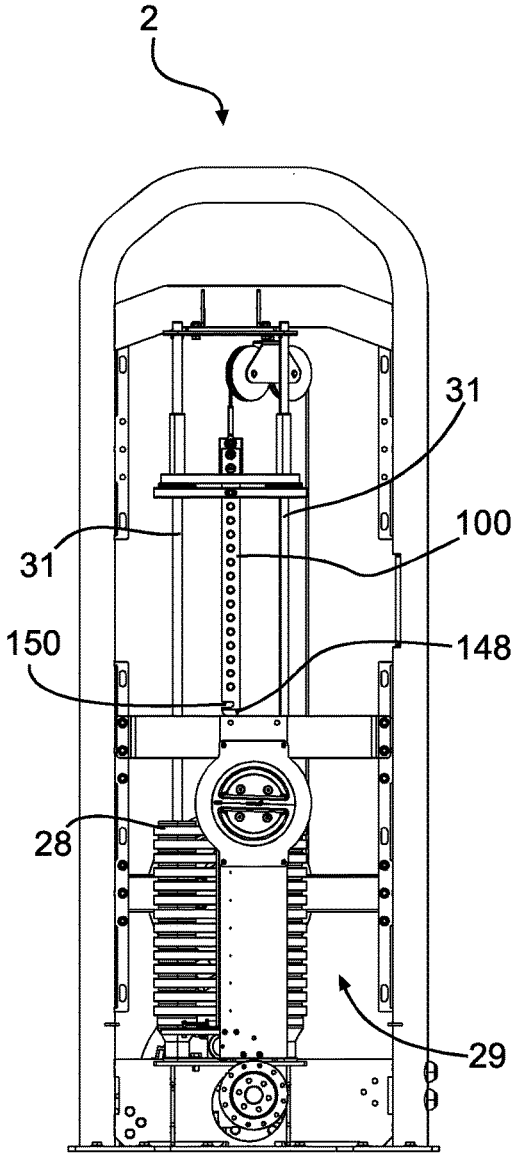
FIG. 13 shows a front view of the weight stack of the machine of FIG. 1 in a lifted position with the housing removed to show the internal details of the mechanism.
Figure 14:
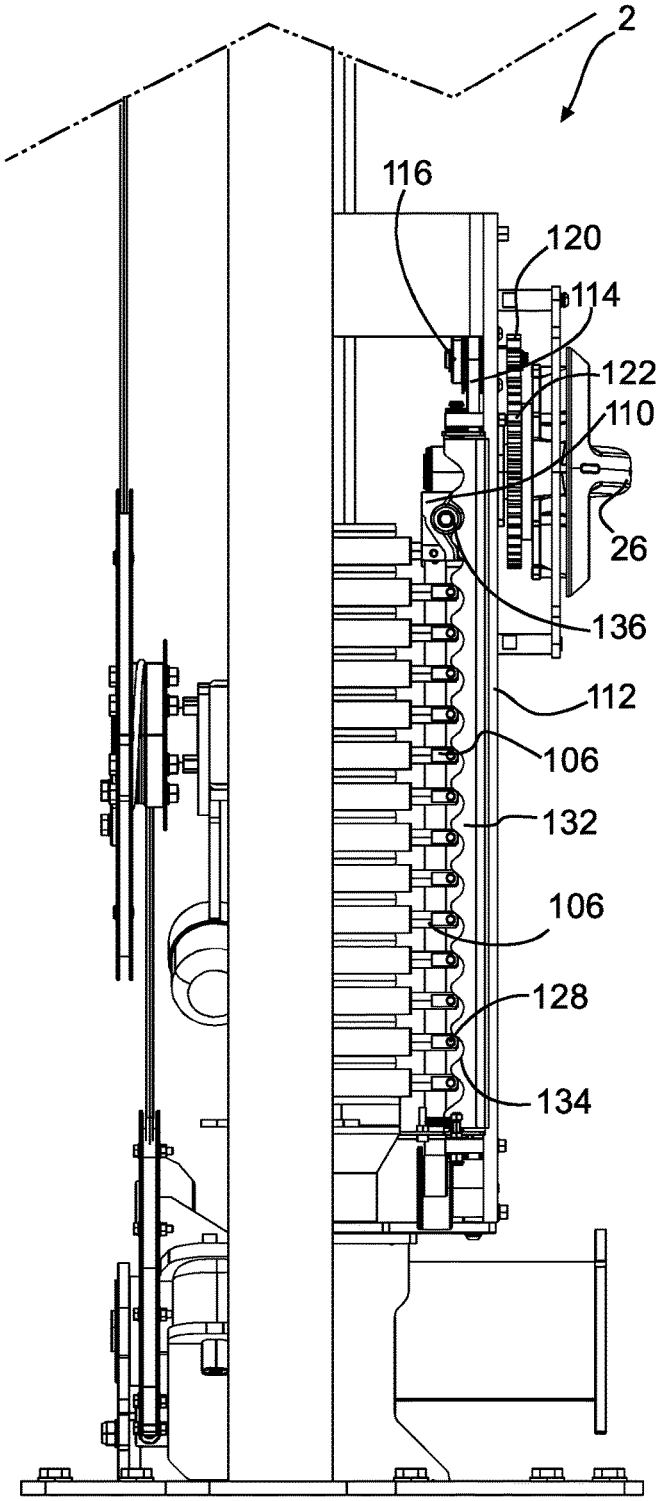
FIG. 14 shows an enlarged partial side view of the weight stack of the machine of FIG. 1 in a lifted position with the housing removed to show the internal details of the mechanism.

The weight selection mechanism comprises a vertically arranged elongated rod member 100 which is provided with a number of holes 102 vertically arrayed along the length of the elongated rod member. Each weight plate 30 is provided with a transverse hole 104 and a pin 106 arranged displaceably in the hole. The pins are more clearly seen in FIGS. 14 and 18. When the pin is pushed in, the pin will engage with a hole in the elongated rod 100 and thereby connect the weight plate to the rod. In FIG. 11, only a single weight plate has been engaged with the elongated rod. When the user lets go of the handle assembly, the elongated rod member will displace downwardly, and the elongated rod member will enter slots 108 in the weight plates. When the elongated rod member is all the way down, then the first safety mechanism will be disengaged, and it will again be possible for the user to rotate the selector handle and choose a different weight.

The pins 106 are arranged to be slidable in the holes 104 in the plates. However, since the entire weight selection mechanism is hidden inside the housing, the weight selection mechanism can push or pull the pins into or out of the weight plates selectively. The weight selection mechanism comprises a displaceable trolley 110 which moves up and down in a track 112. The trolley is driven up and down by a belt 114 which is looped around an upper pulley 116 and a lower pulley 118. The upper pulley is driven by a toothed wheel 120 which is driven by a larger toothed wheel 122 which is rotated by the weight selector handle 26. In this way, as the weight selector handle is rotated by the user, the belt will drive the trolley 110 up and down the track.

Figure 17:
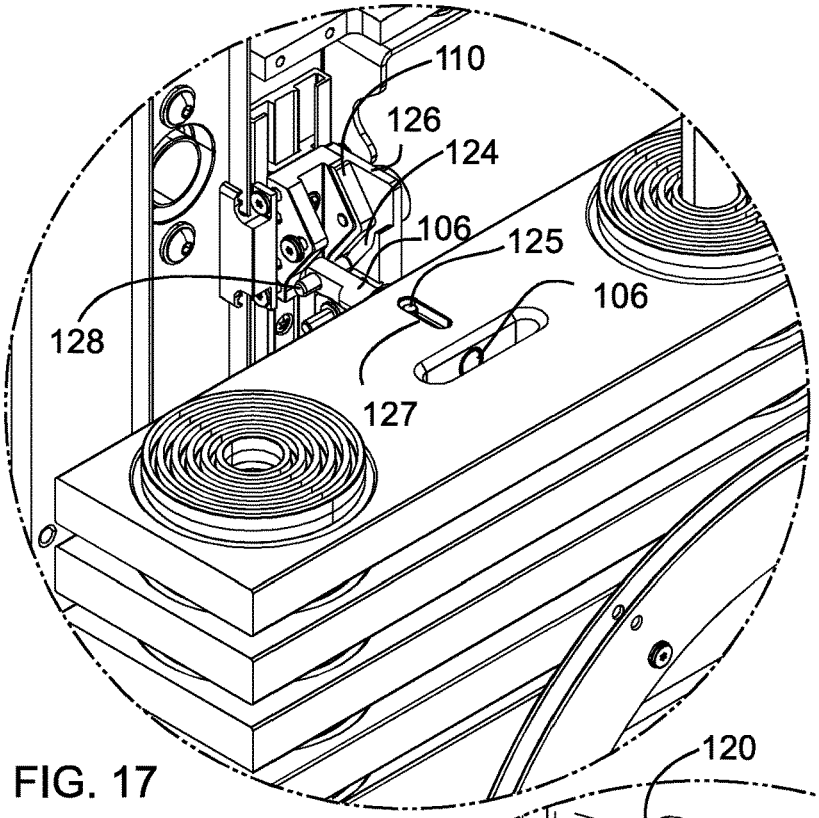
FIG. 17 shows another rear partial perspective view of the weight stack of the machine of FIG. 1 in a position with one weight plate lifted and with a number of parts removed to show the internal details of the mechanism, especially the weight selection mechanism.
Figure 18:
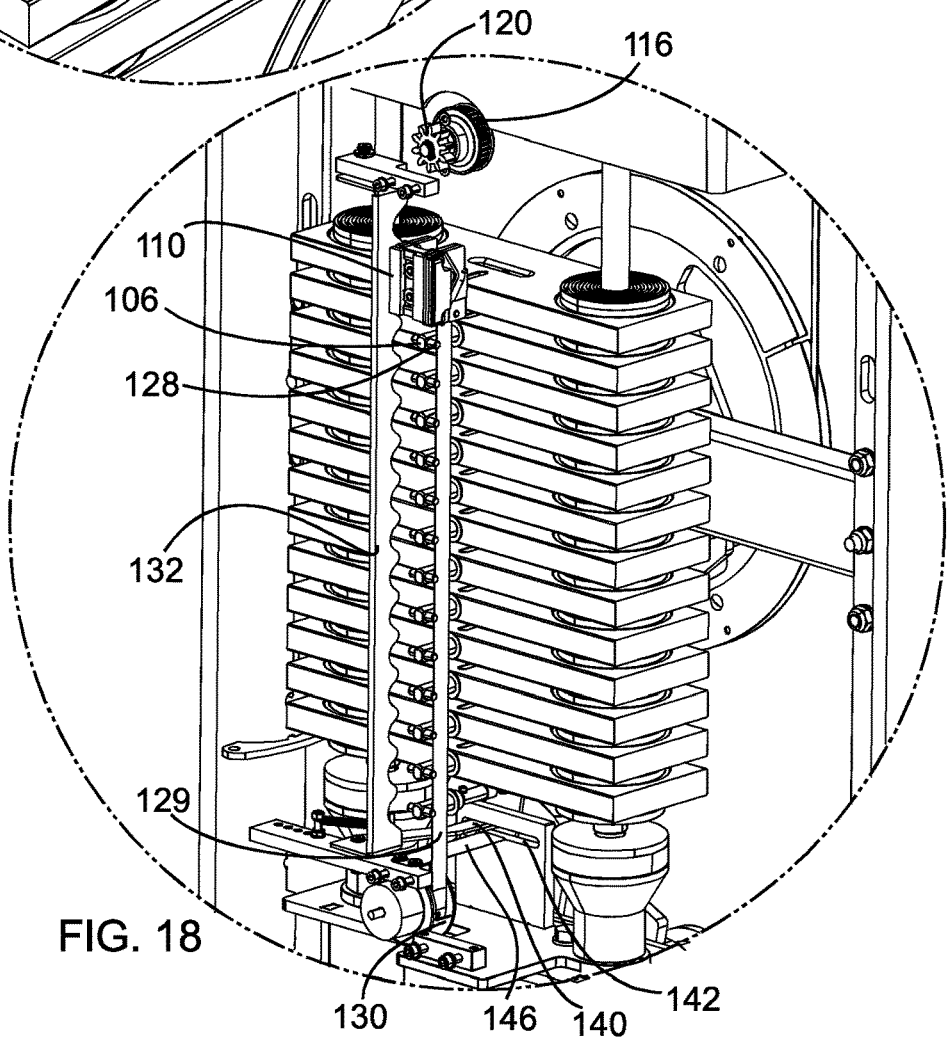
FIG. 18 shows another front partial perspective view of the weight stack of the machine of FIG. 1 in a position with one weight plate lifted and with a number of parts removed to show the internal details of the mechanism, especially the weight selection mechanism.
Figure 19:
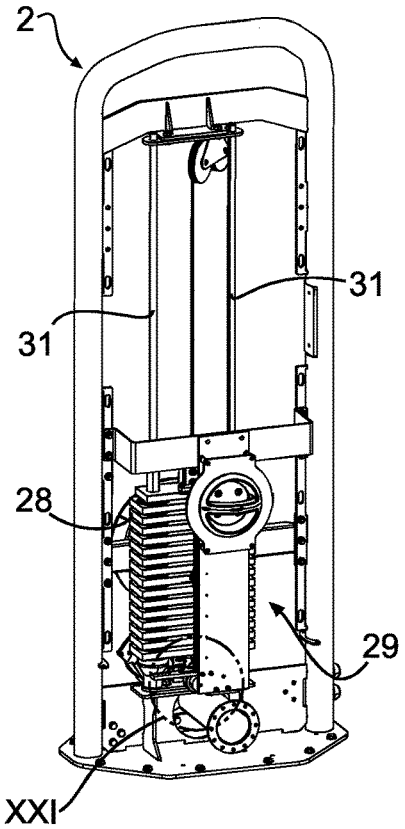
FIG. 19 shows a perspective view of the weight stack of the machine of FIG. 1 in a neutral position.
Figure 20:
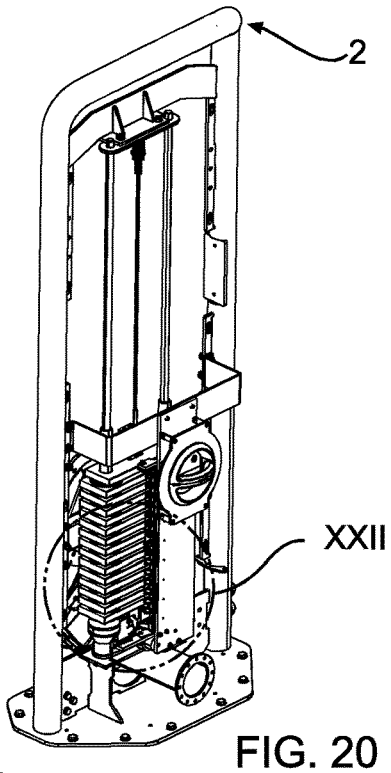
FIG. 20 shows another perspective view of the weight stack of the machine of FIG. 1 in a neutral position.

The trolley has a track 124 in the form of a slot which follows a path as shown in FIG. 17. Note that one of the side plates 126 has been removed in FIG. 17 to better show the shape of the slot. The slot 124 engages with two round horizontally arranged protrusions 128 protruding from the free end of the pins 106. As the trolley moves upwardly past a pin, the upper portion of the slot will engage with the two round horizontal protrusions and pull the pin out of engagement with the vertically arranged rod 100. In this way, the pins will cause the weight plates to disengage with the vertically arranged rod 100. Likewise, when the trolley moves downwardly past a pin, the lower portion of the track 124 will cause the pin to be pushed into the weight plate and the pin will engage the vertically arranged rod thereby connecting the weight plate to the rod.

In order to prevent the pins from accidentally sliding into the weight plate while the weights have been lifted up, a pin motion prevention mechanism is provided. The pin motion prevention mechanism of this embodiment is shown in more detail in FIG. 18. In this embodiment, a band 129 of metal tape has been provided in a rolled up 130 configuration at the bottom of the weight stack. The free end of the metal tape has been attached to the trolley. As the trolley moves up and down, the free end of the metal tape will also move up and down. As the trolley moves up, the tape will roll out and the tape will extend further up the weight stack. As the trolley moves down, a rotational spring in the rolled up portion will cause the tape to roll up and be stored in the rolled up portion. The metal tape in this embodiment is similar to a hand held rolled up tape measure as will be known to the person skilled in the art.

The metal tape is arranged between the round protrusions 128 of the pin and the weight plate itself. The edge of the tape will be in contact with the small protrusion on one side of the pin. This will keep the pin from sliding into the hole in the weight plate during motion of the mechanism. However, when the trolley moves down, since the tape is attached to a lower portion of the trolley, the tape will also move away from the pin and allow it to engage with the weight plate.

It can also be seen from the figures, see especially FIG. 17, that the top side of the pin has a small vertically arranged protrusion 125 arranged in a slot 127 in the weight plate. In this way, the pin is prevented from falling out of the hole. Also, the maximum and minimum positions of the pin are defined by the ends of the slot 127. Since the max and min positions are defined, the tracks in the slot will also properly engage with the small horizontal protrusions on the pins since they will be in the correct position each time.

Figure 15:
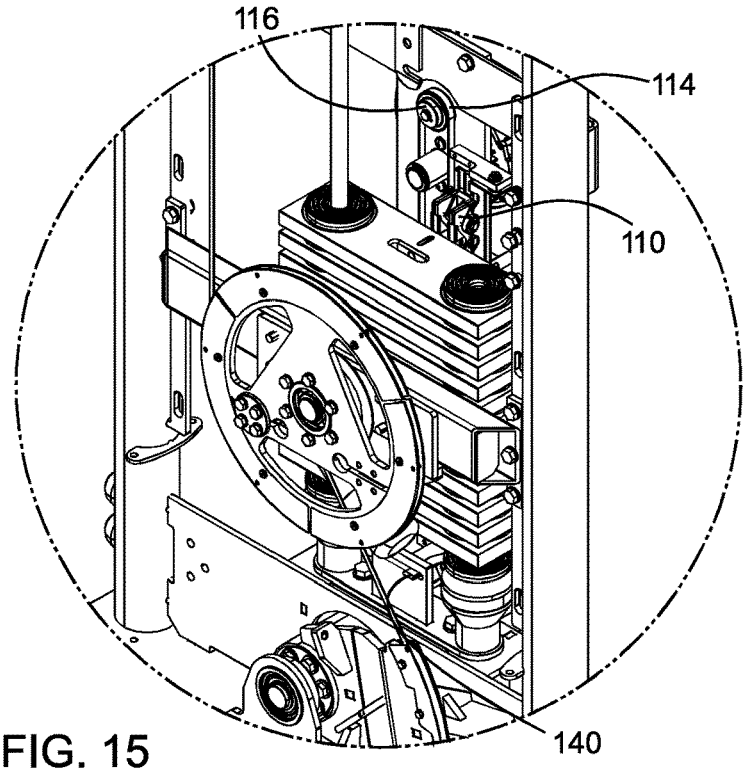
FIG. 15 shows a partial rear perspective view of the weight stack of the machine of FIG. 1 in a position with one weight plate lifted and with a number of parts removed to show the internal details of the mechanism.
Figure 16:
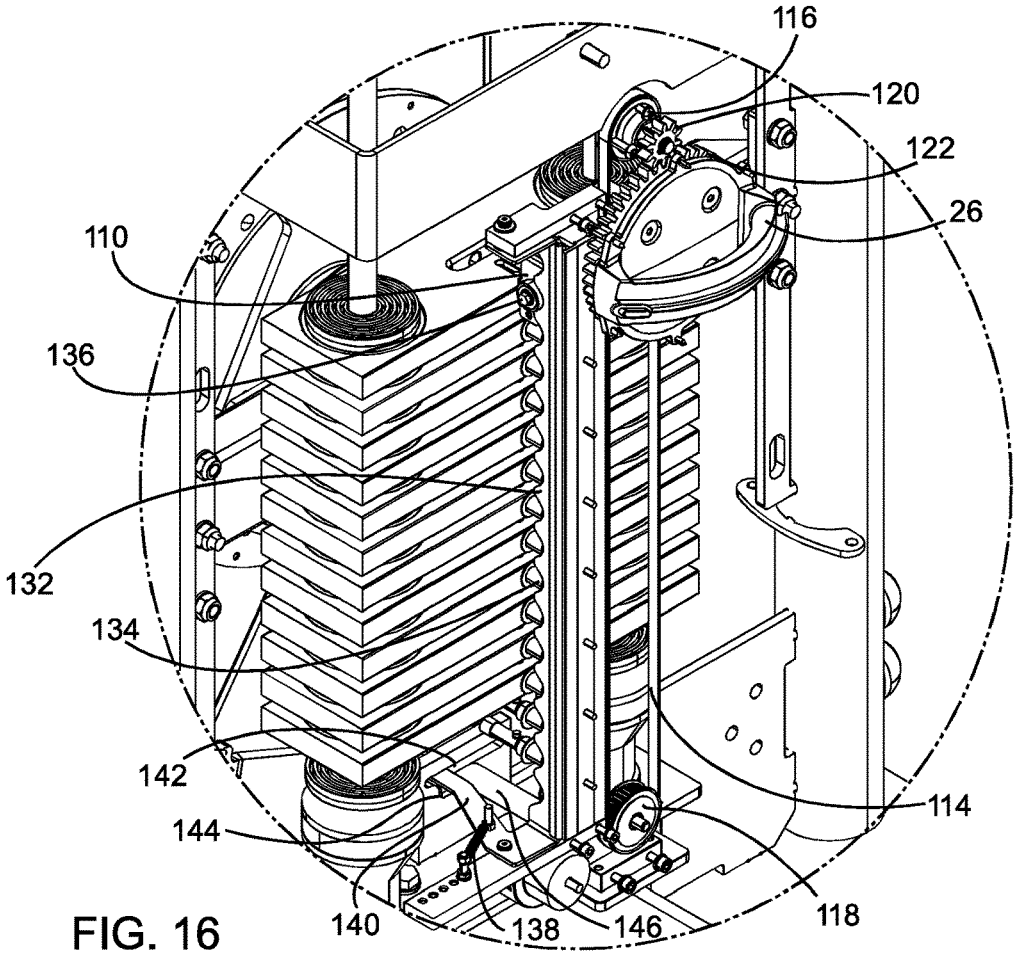
FIG. 16 shows a partial front perspective view of the weight stack of the machine of FIG. 1 in a position with one weight plate lifted and with a number of parts removed to show the internal details of the mechanism.

The first safety mechanism which prevents adjustment of the weight selection mechanism while the weight stack is lifted is best described with reference to FIGS. 15 and 16. The weight selection mechanism comprises a pivotable guide member 132 with a free edge 134 in the shape of a wave with peaks and valleys. Each valley is associated with a specific position relative to the weight stack and each peak is associated with a position of the trolley between two pins. This free edge 134 is engaged with a wheel 136 on the trolley. As the trolley moves up and down, the wheel will also move up and down. As the wheel moves up and down, it will cause the pivotable guide member 132 to pivot outwardly as the wheel passes a peak on the wavy free edge and then pivot inwardly as the wheel rolls into a valley of the wavy free edge. The pivotable guide member is biased into the inward position via a spring 138. Due to the spring, the user will feel feedback from the mechanism and the mechanism will "snap" into stable positions in which the pins are properly arranged. The spring biased guide member will also prevent the trolley from accidentally moving up or down. The trolley will be held in a stable position until the user applies enough force to the rotatable selector to push the guide member against the force of the spring.

The bottom of the pivotable guide member, has a lever 140 which also pivots back and forth together with the guide member 132. The lever is arranged in a slot 142 in the rear of the mechanism. The lever 140 also has a downward protruding flange 144 which engages with a steel plate spring 146. When the steel plate spring is in the position shown in FIG. 16, the lever 140 is prevented from pivoting and therefore the guide member 132 is also prevented from pivoting. This locks the selection mechanism and prevents the user from adjusting the selector handle since the wheel 136 cannot traverse the peaks of the guide member since the guide member is locked in position.

Figure 22:
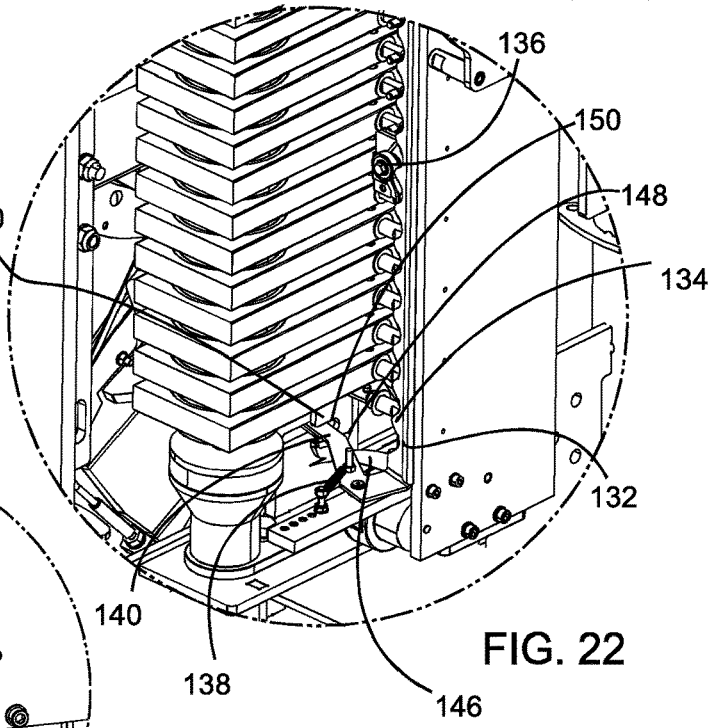
FIG. 22 shows a detailed view as defined by the circle XXII in FIG. 20.
Figure 21:
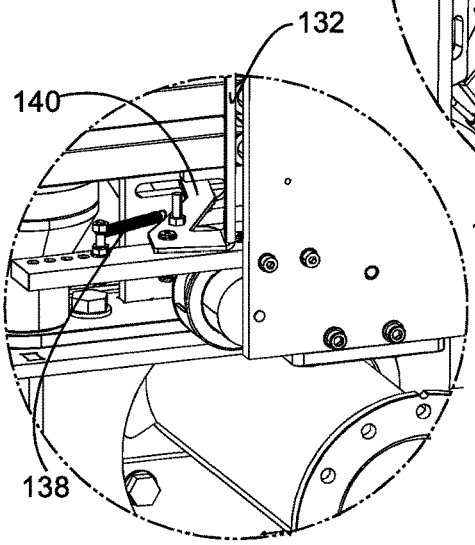
FIG. 21 shows a detailed view as defined by the circle XXI in FIG. 19.

When the elongated rod 100 moves downwardly and is in its lowest position, as shown in FIGS. 21 and 22, the bottom portion 148 of the elongated rod engages with the steel plate spring and bends it downwardly. When the plate spring bends downwardly, the downward protruding flange 144 on the lever 140 is able to move past the downwardly deflected plate spring. This allows the lever 140 to pivot again and thereby allows the guide member to pivot as well, thereby freeing the wheel 136 and the trolley 110 to move up and down again.

A second safety mechanism is also provided to prevent the weight stack from being lifted during the adjustment of the weights. This is also shown in FIGS. 21 and 22. The bottom portion of the elongated rod 100 is provided with a slot 150. When the lever of the guide member 132 is pivoted due to the motion of the trolley, the lever will engage with the slot 150 in the bottom portion of the elongated rod and the elongated rod is prevented from being displaced upwardly. Hence, when the selector handle is in between two stable positions, the guide member will be pivoted and the lever will be engaged with the elongated rod 100, thereby preventing the elongated rod and the connected weight stack from being lifted up. First when the trolley is in a stable position between two peaks, will the lever again be disengaged with the elongated rod and allow it to move up and down.

Another feature of the current invention is that the width of the main frame of the weigh selection assembly is chosen to be wide enough to support both larger plates and smaller plates. In certain weight lifting machines, a larger number of smaller plates is desired, as the total weight lifted will be less but it is desired to provide a greater selection of weights. This is typical for upper body machines. In other weight lifting machines, a lower number of larger plates is desired as larger weights need to be lifted. This is typical for weight lifting machines which are targeted the lower body. From FIG. 13 it can be seen that the weight stack 28 is arranged offset in the weight stack assembly.

There is "free space" 29 beside the weight stack 28. In the case where larger plates are necessary, this space can be used. The larger plates will therefore be centered in the weight stack assembly, and the vertical guide bars 31 will also be centered in the weight stack assembly, in contrast to the current embodiment where the vertical guide bars 31 are arranged offset from the center of the weight stack assembly.

Another benefit of this offset position of the weight plates is that there is room for an upper positioned horizontal beam, as for example in the machine shown in FIGS. 3, 4 and 7-10. In this type of machine, the horizontal beam can be well supported in the frame of the weight stack and the actual weight stack can displace on one side of the horizontal bar. This is mostly relevant for upper body machines which also typically make use of smaller plates.

FIGS. 23-41 shows a weight stack assembly 200 according to an alternative embodiment of the disclosure. The weight stack assembly 200 may be used in the weight lifting machine 1 or the weight lifting machine 50 in place of the weight stack assembly 2 or the weight stack assembly 52 respectively.

In FIGS. 23-41, the function of the mechanism of the weight stack assembly 200 is described in more detail via different views of the mechanism. In different views, different components have been removed to show components located behind other components.

Figure 23:
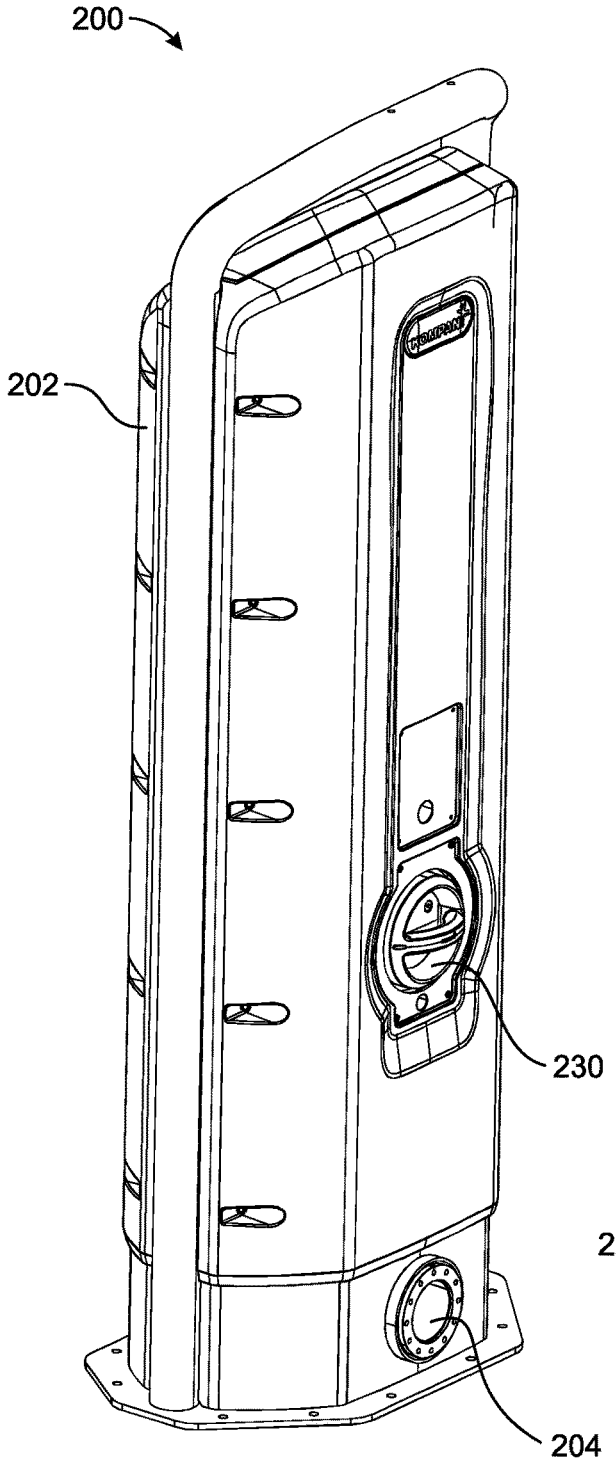
FIG. 23 shows a front perspective view of an alternative weight stack assembly.
Figure 24:
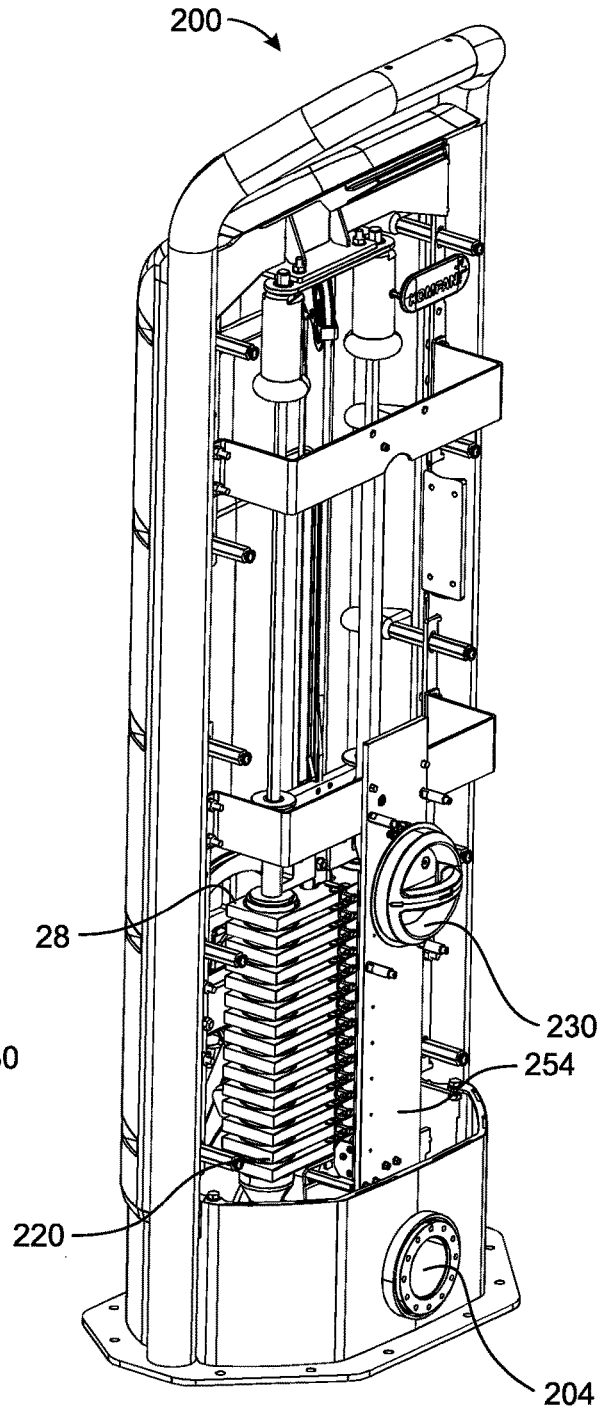
FIG. 24 shows a front perspective view of the weight stack assembly from FIG. 23 with the housing removed to show the internal details of the mechanism.

Referring to FIGS. 23 and 24, the weight stack assembly 200 comprises a housing 202 which completely encloses the moving parts inside the weight stack assembly 200. An opening 204 in the housing 202 is provided through which a horizontal bar enters the housing 202 and moves the mechanism inside the housing 202. By comparing the weight stack assembly 200 with the weight stack assembly 2, it can be seen that for the most part, except for a weight selection mechanism, a first safety mechanism, a second safety mechanism, and a pin motion prevention mechanism, the weight stack assembly 200 and the weight stack assembly 2 are identical. Accordingly, weight plates and weight displacement mechanism of the weight stack assembly 200 are similar to the weight plates 30 and the weight displacement mechanism for the weight stack assembly 2.

As shown in FIGS. 25 to 33, the weight selection mechanism includes a vertically arranged elongated rod member 210 which is provided with a number of holes 212 vertically arrayed along the length of the elongated rod member 210. As shown, the elongated rod member 210 includes a substantially H shaped configuration when viewed from the top with a central elongated plate with a vertical array of holes and two elongated side plates attached to the longitudinal side edges of the central elongated plate to provide additional rigidity to the central elongated plate. Each weight plate 220 of the weight stack 28 is provided with a transverse hole 222 and a pin 226 arranged displaceably in the hole 222. The pins 226 are more clearly seen in FIGS. 28 and 32. When the pin 226 is pushed in, the pin 226 will engage with a hole 212 in the elongated rod member 210 and thereby connect the weight plate 220 to the elongated rod member 210. When the user lets go of the handle assembly, the elongated rod member 210 will displace downwardly and the elongated rod member 210 will enter slots 228 in the weight plates 220. When the elongated rod member 210 is all the way down, then a first safety mechanism will be disengaged, and it will again be possible for the user to rotate a weight selector handle 230 (described later) and choose a different weight.

The pins 226 are arranged to be slidable in the holes 222 in the weight plates 220. However, since the entire weight selection mechanism is hidden inside the housing 202, the weight selection mechanism is used to push or pull the pins 226 into or out of the weight plates 220 selectively. The weight selection mechanism comprises a displaceable trolley 232 which moves up and down in a track 234. The trolley 232 is driven up and down by a belt 236 which is looped around an upper pulley 238 and a lower pulley 240. The upper pulley 238 is driven by a toothed wheel 242 which is driven by a larger toothed wheel 244 which is rotated by the weight selector handle 230. The function of the pulley of this embodiment is similar to the function of the trolley in the previous described embodiments.

Figure 26:
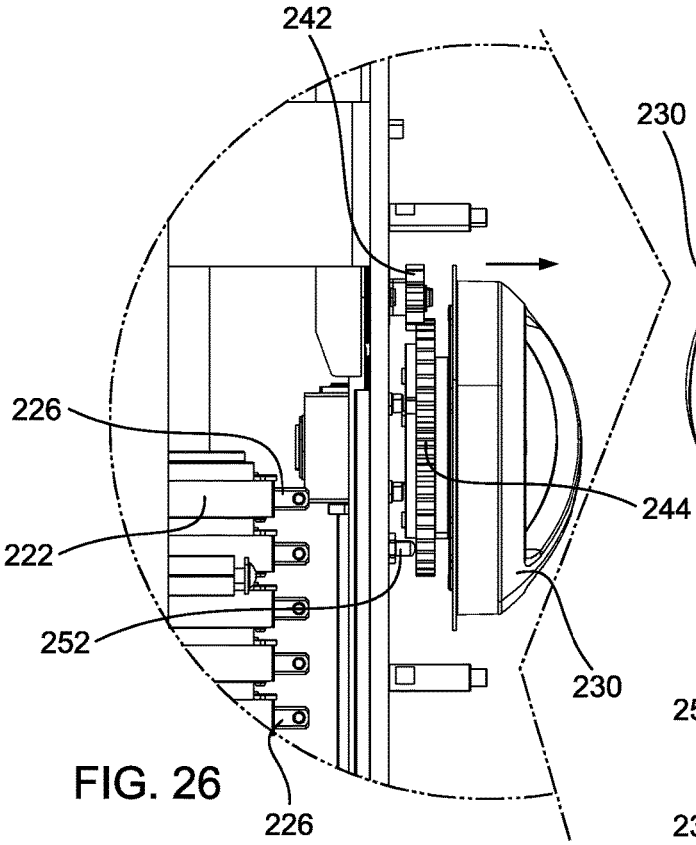
FIG. 26 shows a partial side view of the weight stack assembly of FIG. 23 depicting a weight selector handle pulled out and pin disengaged from a toothed wheel and with a number of parts removed to show the internal details of the mechanism.
Figure 27:
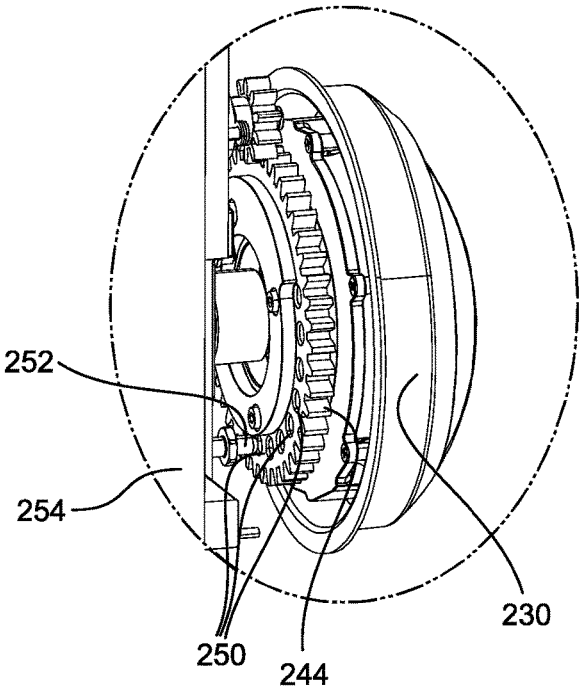
FIG. 27 shows a partial rear perspective view of weight stack assembly of FIG. 23 depicting an indexing mechanism for the weight selector handle with a number of parts removed to show the internal details of the mechanism.
Figure 28:
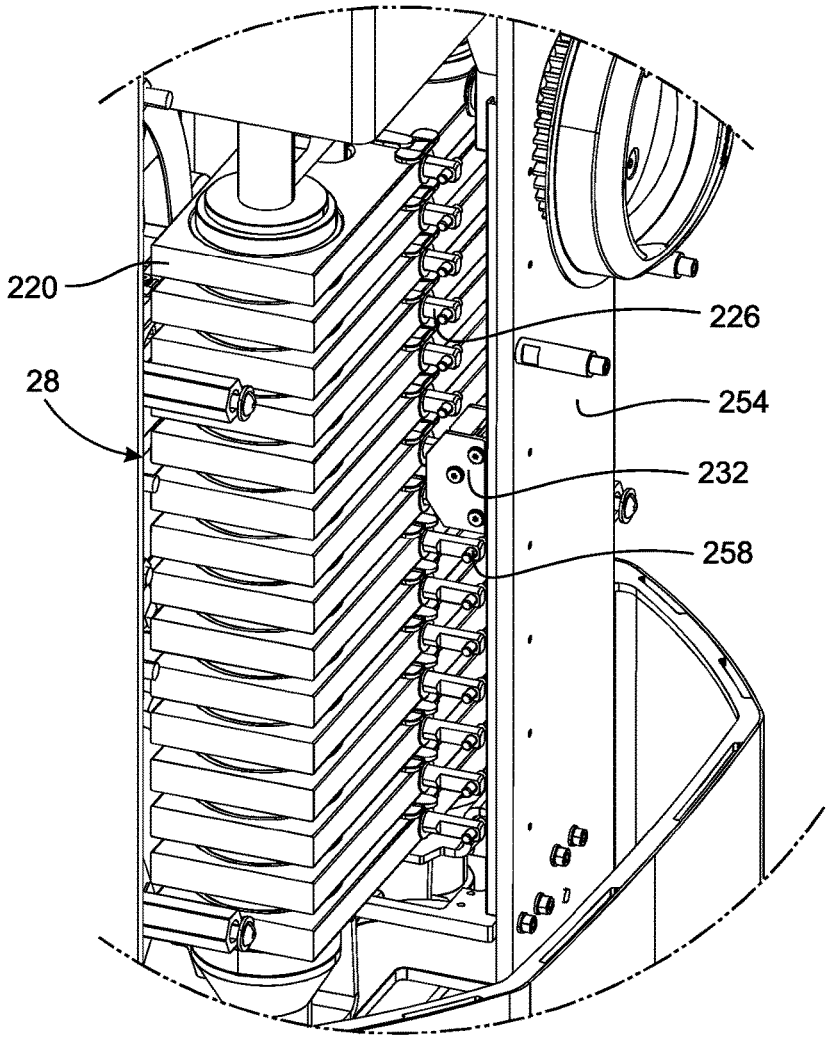
FIG. 28 shows an enlarged left front perspective view of the weight stack assembly of FIG. 23 with the housing removed and depicting a trolley arranged in an intermediate position and a number of pins arranged above the trolley pushed inside an elongated rod member and a number of pins arranged below the trolley arranged outside the elongated rod member.
Figure 37:
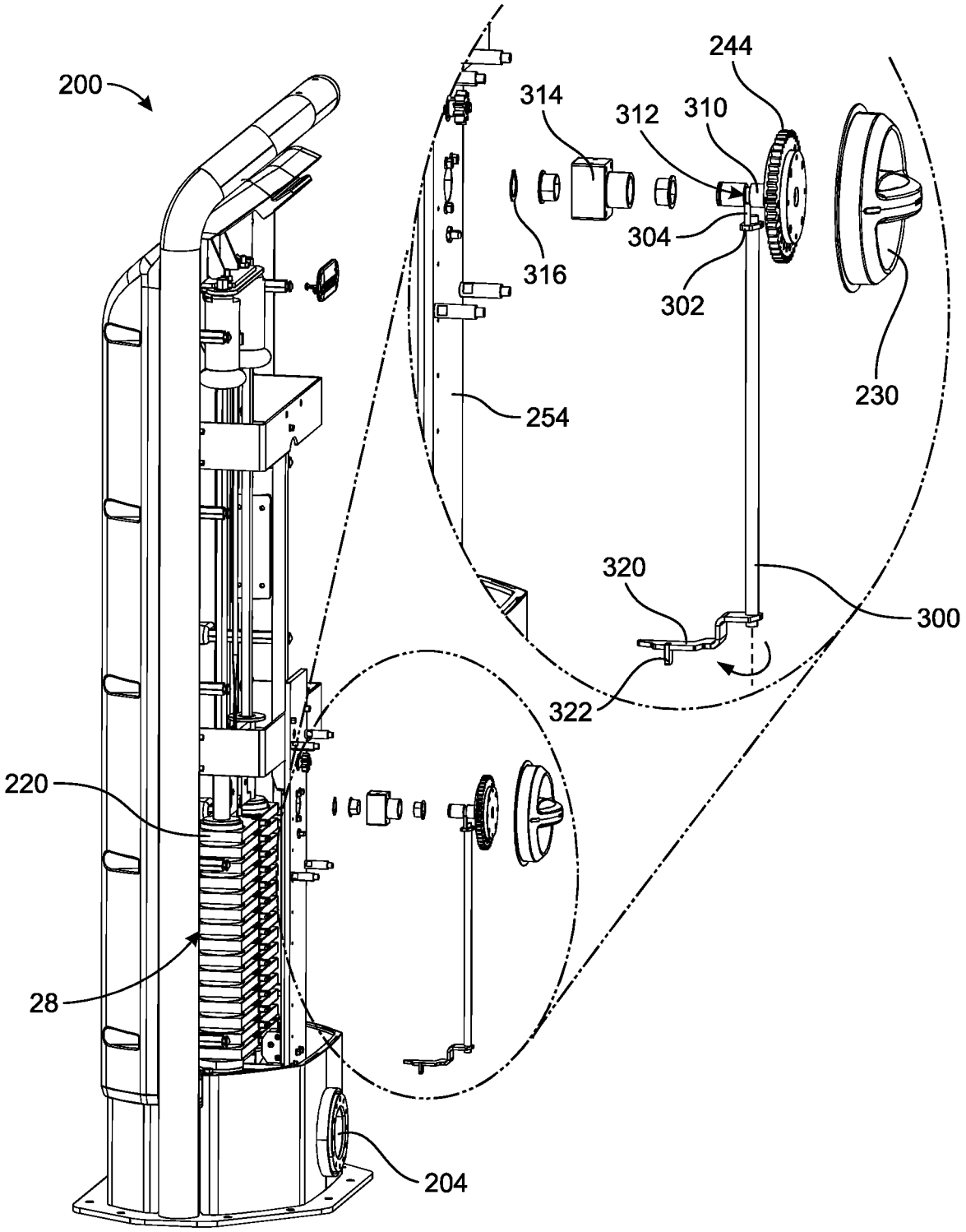
FIG. 37 shows a side perspective view of the weight stack assembly of the FIG. 23 with housing removed and depicting an enlarged exploded view of the weight selection mechanism and the first safety mechanism.

However, in this embodiment, to rotate the weight selector handle 230, the weight selector handle 230 needs to be pulled out relative to the housing 202. As shown in FIGS. 26, 27 and 37, the weight selector mechanism includes an indexing mechanism having a plurality of holes 250 defined along a periphery of the toothed wheel 244 and at least one pin 252 extending in a horizontal direction from a bracket 254 of the housing 202. The pin 252 is inserted inside one of the holes 250 to ensure the amount of the weight, selected by the user, is engaged to the elongated rod member 210. To select the desired weight, the user, at first, pulls out the weight selector handle 230, causing the disengagement of the pin 252 from the hole 250 (as shown in FIGS. 26 and 27). Thereafter, the user rotates the weight selector handle 230 to choose the desired weight. As the weight selector handle 230 is rotated by the user, the belt 236 will drive the trolley 232 up and down the track 234. The user then pushes the weight selector handle 230 towards the bracket 254, causing an insertion of the pin 252 inside a suitable hole 250. Accordingly, the weight selector handle 230 and hence the toothed wheel 244 is locked into the desired position, thereby securing the desired number of weight plates 220 with the elongated rod member 210. It may be appreciated that the toothed wheel 244 is fixedly attached to the weight selector handle 230 and moves linearly and rotates about its own axis in response to the linear and rotational movement of the weight selector handle 230. In an embodiment, the rear side of the holes 250 are chamfered to enable an insertion of the pin 252 inside the hole 250 even if there is a slight offset between an axis of the pin 252 and an axis of the hole 250 during the insertion of the pin 252 into the hole 250.

Likewise, the end of the pin 252 is rounded to make it even easier to align the pin with the selected hole.

Figure 29:
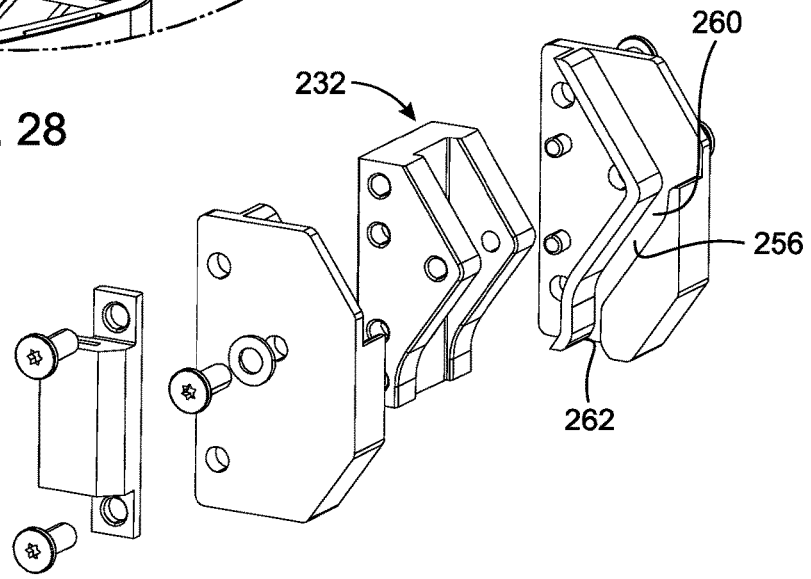
FIG. 29 shows an exploded view of the trolley depicting a slot having an upper opening and a lower opening.

The trolley 232 has a track 256 in the form of a slot which follows a path as shown in FIG. 29. The slot 256 engages with two round horizontally arranged protrusions 258 protruding from the free end of the pins 106. As the trolley 232 moves upwardly past a pin 226, the two horizontal protrusions 258 enter the slot 256 through an upper opening 260 of the slot 256 and move inside the upper portion of the slot 256. In so doing, the upper portion of the slot 256 engages with the two horizontal protrusions 258 and will pull the pin 226 out of the engagement with the vertically arranged rod 100. In this way, the pins 226 will cause the weight plates 220 to disengage with the vertically arranged rod 100. Likewise, when the trolley 232 moves downwardly past a pin 226, the two horizontal protrusions 258 enter the slot 256 through a lower opening 262 of the slot 256 and move along a lower portion of the slot 256. In so doing, the lower portion of the track 256 will cause the pin 226 to be pushed into the weight plate 220 and the pin 226 will engage the vertically arranged elongated rod member 210 thereby connecting the weight plate 220 to the elongated rod member 210. Please note that the trolley in FIG. 29 is shown from another side than in FIG. 28. Hence in FIG. 28 as the trolley moves downwardly, the pins will move to the left in FIG. 28. In contrast since the trolley is shown from the other side in FIG. 29, as the trolley moves downward the pins will move to the right in FIG. 29. Compare also to FIG. 17 which shows the trolley from another angle again together with the pin.

In order to prevent the disengaged pins 226 from accidentally sliding into the weight plates 220 while the weights have been lifted up, for example due to vibrations or other forces provided by a user activating the machine, a pin motion prevention mechanism is provided. Referring to FIGS. 30 to 33, the pin motion prevention mechanism of this embodiment is shown in more detail. In this embodiment, a clip 264 is engaged with the weight plate 220 and includes a flange 266 arranged abutting an upper surface of the weight plate 220 and a pair of legs 268 extending downwardly from the flange 266 and extending inside the weight plate 220 engaging the clip 264 with the weight plate 220. As shown, the flange 266 includes a central portion 270 aligned with a slot 272 in the weight plate 220. In the embodiment, the central portion 270 is a tapered portion tapering downwardly from an outer edge of the weight plate 220 to the slot 272. The flange 266 is arranged on the weight plate 220 and extends in a direction substantially perpendicular to a longitudinal axis of the pin 226. Further, the pin motion prevention mechanism includes a locking plate 276 having a vertically arranged protrusion 278 or leg adapted to be removably coupled with the pin 226. A portion of the protrusion 278 is arranged inside the pin 226 to enable the engagement of the locking plate 276 with the pin 226. In an assembly of the locking plate 276 with the weight plate 220 and the pin 226, a top portion of the protrusion 278 is arranged in the slot 272 in the weight plate 220 to prevent the pin 226 from falling out of the hole 222 of the weight plate 220. Also, the maximum and minimum positions of the pin 226 are defined by the ends of the slot 272. Since the max and min positions are defined, the tracks in the slot 256 of the trolley will also properly engage with the small horizontal protrusions 258 on the pins 226 since they will be in the correct position each time.

Figure 30:
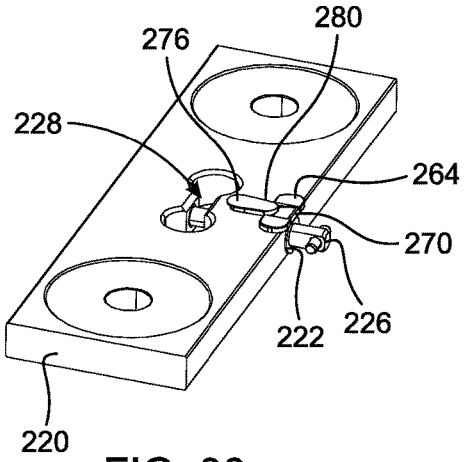
FIG. 30 shows a top perspective view of a pin motion prevention mechanism engaged with a single weight plate and depicting a locking plate disengaged from a clip of the pin motion prevention mechanism.
Figure 31:
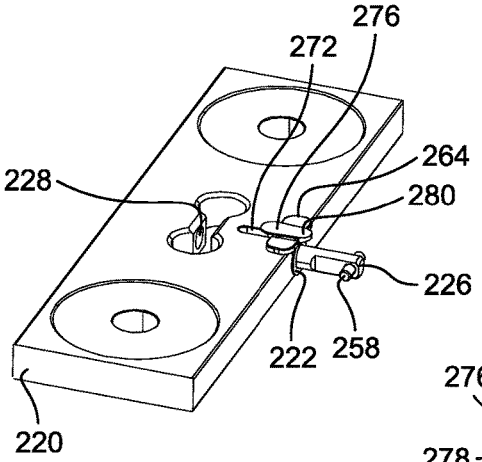
FIG. 31 shows a top perspective view of the pin motion prevention mechanism engaged with a single weight plate and depicting a locking plate engaged with a clip of the pin motion prevention mechanism.
Figure 33:
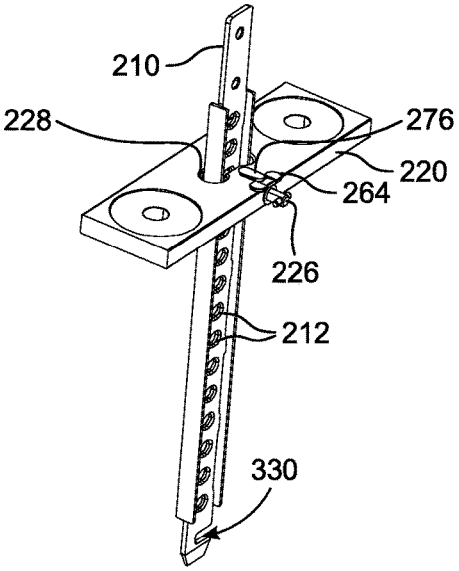
FIG. 33 shows a top perspective view of a single weight plate engaged with the elongated rod member via a pin.
Figure 32:
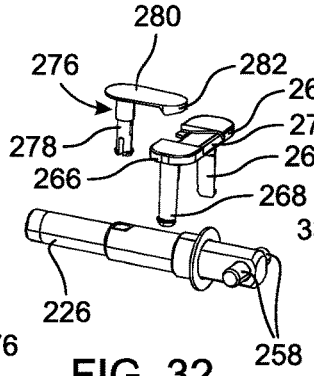
FIG. 32 shows a top perspective view of the clip, the locking plate, and the pin disengaged from the weight plate to show the structural details of the components.

Moreover, the locking plate 276 includes a horizontally arranged plate 280 connected to an upper end of the vertical protrusion 278 and a vertically arranged skirt 282 extending downwardly from the plate 280 and arranged at an edge of the plate 280. The vertical skirt 282 is disposed spaced apart and substantially parallel to the protrusion 278 and is adapted to engage with the clip 264. The locking plate 276 is adapted to displace or reciprocate relative inside the slot 272 of the weight plate 220 as the pin 226 is moved inside or outside of the hole 212 of the elongated rod 210. As the trolley 232 moves upwardly, the locking plate 276 will move away from the elongated rod 210 along with the pin 226 and causing the vertical skirt 282 to engage with an edge of the central portion 270 of the clip 264 as shown in FIG. 31. Accordingly, the locking plate 276 is snap fitted with the clip 264, preventing any movement of the pin 226 towards the elongated rod 210 due to vibrations. As the trolley 232 moves downwardly, the pin 226 moves towards the elongated rod 210. In so doing, a force is applied on the locking plate 276, causing a disengagement of the vertical skirt 282 from the edge of the central portion 270 of the clip 264 as shown in FIG. 30. Accordingly, the locking plate 276 moves away from the clip 264 and towards the elongated rod member 210 along with the pin 226.

The first safety mechanism which prevents adjustment of the weight selection mechanism while the weight stack is lifted is best described with reference to FIGS. 35, 36, 37, 40 and 41. The weight selection mechanism comprises a rotatable rod 300, a lever 302 connected to a top end of the rod 300, and a pin 304 connected to the lever 302 and engaged with a shaft 310 rotatably supporting the toothed wheel 244. The top end of the rod 300 extends through a hole in the lever 302 and is arranged at an offset from a center of the lever 302. Similarly, the pin 304 is arranged at an offset from the center of the lever 302 and arranged opposite to the rod 300. A top end of pin 304 is arranged inside a groove 312 of the shaft 310. Further, the shaft 310 is supported by a box shaped housing 314 such that a free end of the shaft 310 extends outside the housing 314 and the groove 312 is arranged inside the housing 314. The housing 314 is fixedly attached to the bracket 254 such that the bracket 254 is arranged between the toothed wheel 244 and the housing 314 and the shaft 310 extends through the bracket 254. Further, the top end of the rod 300 is also rotatably supported by the housing 314. A circlip 316 is mounted on the shaft 310 and is arranged outside the housing 314 between the free end of the shaft 310 and housing 314. A gap defined between the circlip 316 and the housing 314 defines a distance to which the weight selector handle 230 can be pulled/moved outwardly.

As the weight selector handle 230 is linearly displaced, the pin 304 is also linearly displaced with weight selector handle 230 as the weight selector handle 230 is attached to the shaft 310. Due to the linear displacement of the pin 304, the lever 302 pivots, causing a rotation of the rod 300 about a central longitudinal axis of the rod 300. Accordingly, as the weight selector handle 230 is pulled outwardly, the pin 304 moves along with the shaft 310, resulting into a rotation of the rod 300 in a first direction. As the weight selector handle 230 is moved back towards the housing 314, the pin 304 moves back linearly along with the shaft 310, causing the rotation of the rod 300 in a second direction opposite to the first direction. The rod 300 rotates about the central axis due of the pivoting of the lever 302 as the rod 300 is constrained from moving in a horizontal direction. In an embodiment, a biasing mechanism may be provided to move the weight selector handle 230 back upon release of the weight selector handle 230 by the user. In an embodiment, the biasing mechanism may include a magnet attached to the bracket 254 to magnetically pull the weight selector handle 230 towards the bracket 254. In this embodiment, the magnet is attached to the side of the bracket opposite to the gear wheel and is hidden in the view in FIG. 37.

Figure 40:
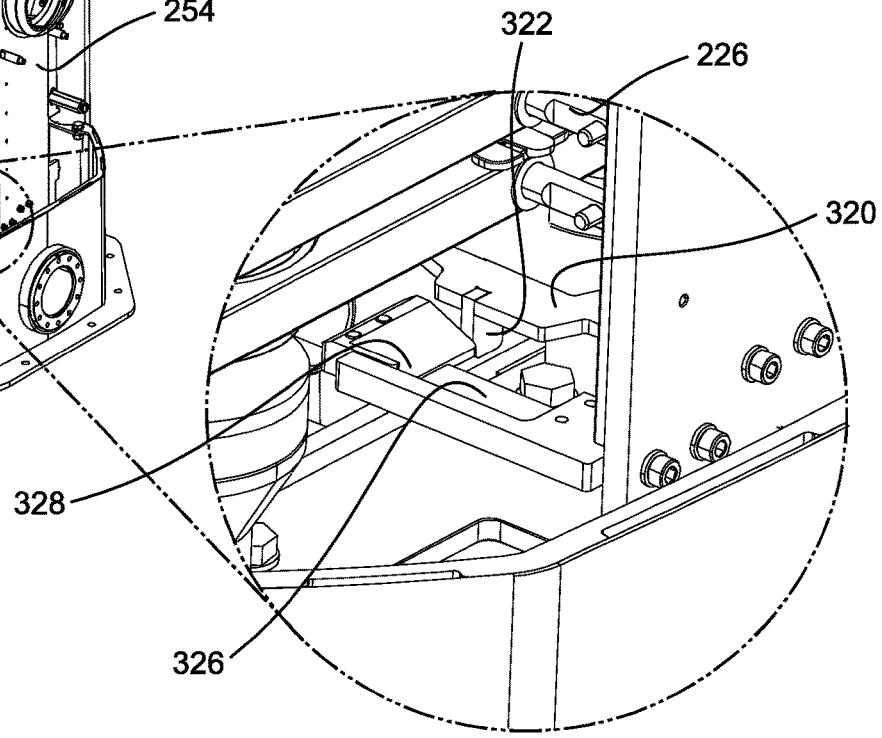
FIG. 40 shows an enlarged view of a portion of the weight stack assembly of FIG. 38 with a number of parts removed and depicting a vertical flange of a lever of the first safety mechanism in contact with the plate spring.

The bottom of the rod 300 is connected to a lever 320 which pivots back and forth as the rod 300 rotates in the first direction and the second direction. As shown in FIG. 40, the lever 320 also has a downward protruding flange 322 which engages with a steel plate spring 326. When the steel plate spring 326 is in a neutral position, the lever 320 is prevented from pivoting as the rod 300 rotates in the first direction and therefore the rod 300 is also prevented from rotating in the first direction. This locks the weight selection mechanism and prevents the user from pulling the weight selector handle 230 outwardly for rotating the weight selector handle 230

Figure 41:
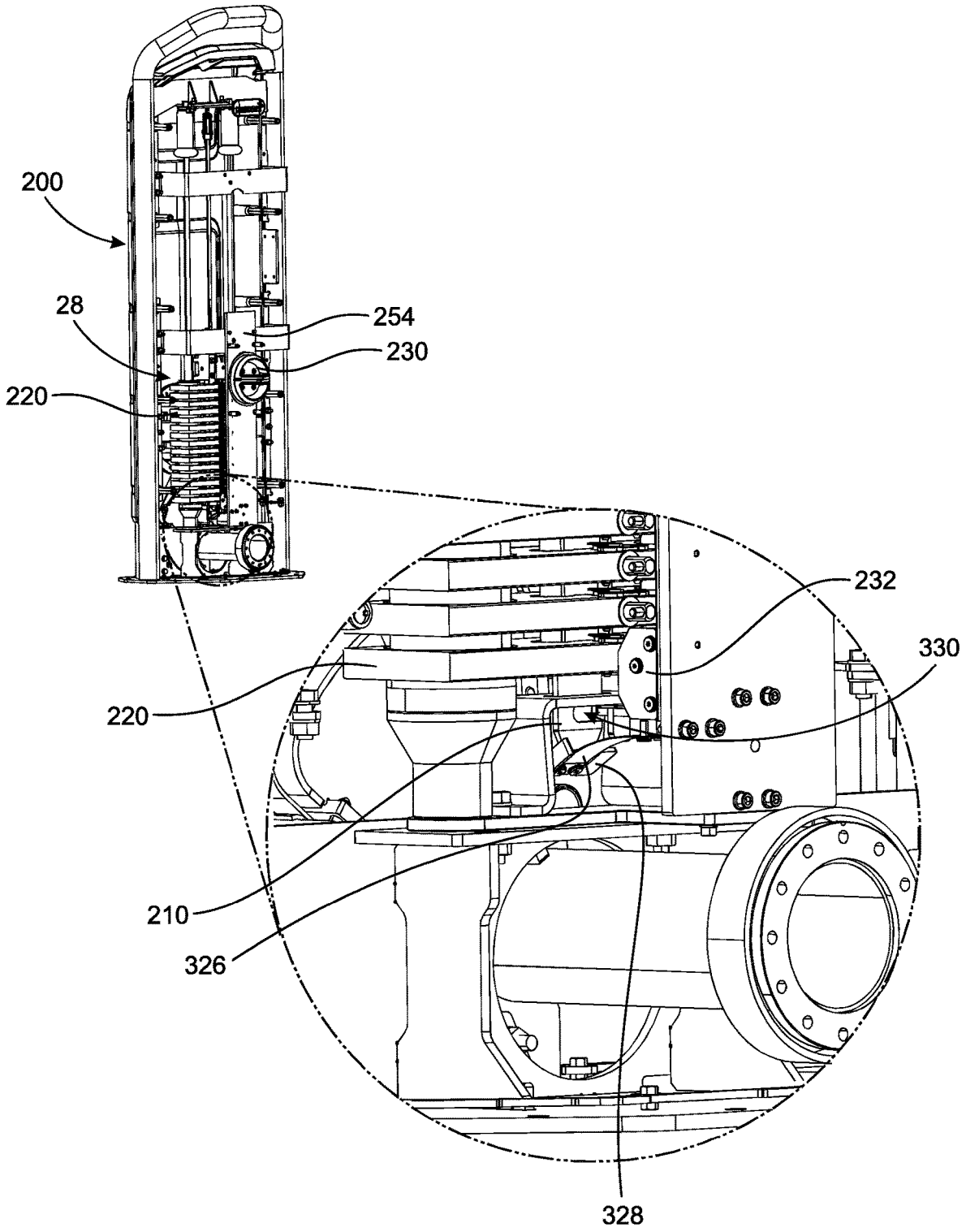
FIG. 41 shows a left front perspective view of the weight stack assembly of FIG. 23 with the housing removed and depicting an enlarged view of a lower portion of the weight stack assembly having the elongated rod member pushing the plate spring downwardly.

When the elongated rod member 210 moves downwardly and is in its lowest position, a bottom portion of the elongated rod member 210 engages with the steel plate spring 326 and bends it downwardly as shown in FIG. 41. When the plate spring 326 bends downwardly, the downward protruding flange 322 on the lever 320 is able to move past the downwardly deflected plate spring 326. This allows the lever 320 to pivot again and thereby allows the rod 300 to rotate in the first direction as well, thereby freeing the toothed wheel 244 and the weight selector handle 230. Additionally, a small plastic plate 328 is mounted on the plate spring 326. The plastic plate 328 is arranged to provide a vertical force on the plate spring 326 when the elongated rod member 210 is pressing the plate spring 326 downwardly.

Figure 25:
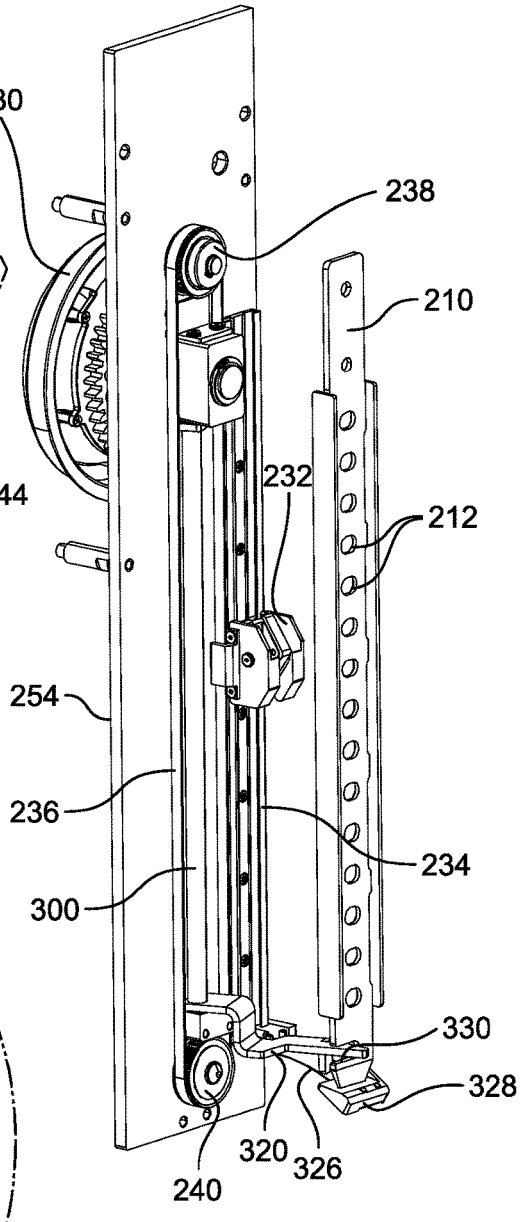
FIG. 25 shows a rear perspective view of a weight selection mechanism of the weight stack assembly of FIG. 23 removed from the housing and with a number of parts removed to show the internal details of the mechanism.

A second safety mechanism is also provided to prevent the weight stack from being lifted during the adjustment/selection of the weights. This is shown in FIGS. 25, 40 and 41. The bottom portion of the elongated rod member 210 is provided with a slot 330. When the lever 320 of the rod 300 is pivoted due to the outward motion of the weight selector handle 230, the lever 320 will engage with the slot 330 in the bottom portion of the elongated rod 210 and the elongated rod member 210 is prevented from being displaced upwardly. Hence, when the selector handle 230 is pulled outwardly and is being rotated to engage the desired amount of weight with the elongated rod 210, the lever 320 will be engaged with the elongated rod member 210, thereby preventing the elongated rod 210 member and the connected weight stack from being lifted up. When the weight selector handle 230 is moved back to its neutral position, the lever 320 will again be disengaged with the elongated rod 210 to allow the elongated rod member 210 to move up and down.

Figure 34:
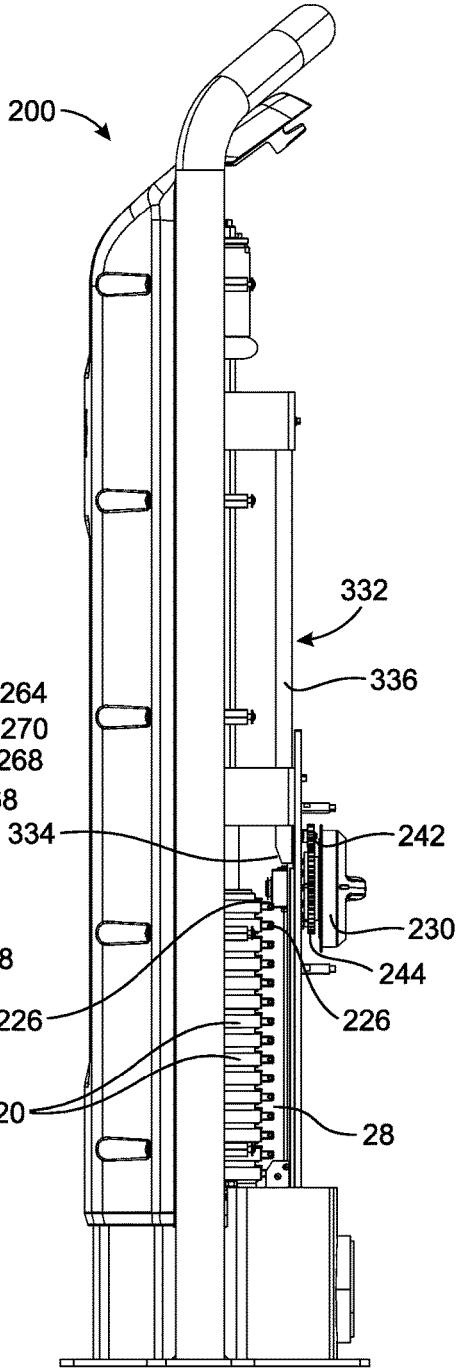
FIG. 34 shows a side view of the weight stack assembly of FIG. 23 with housing and a number of parts removed to show the internal details of the mechanism.
Figure 35:
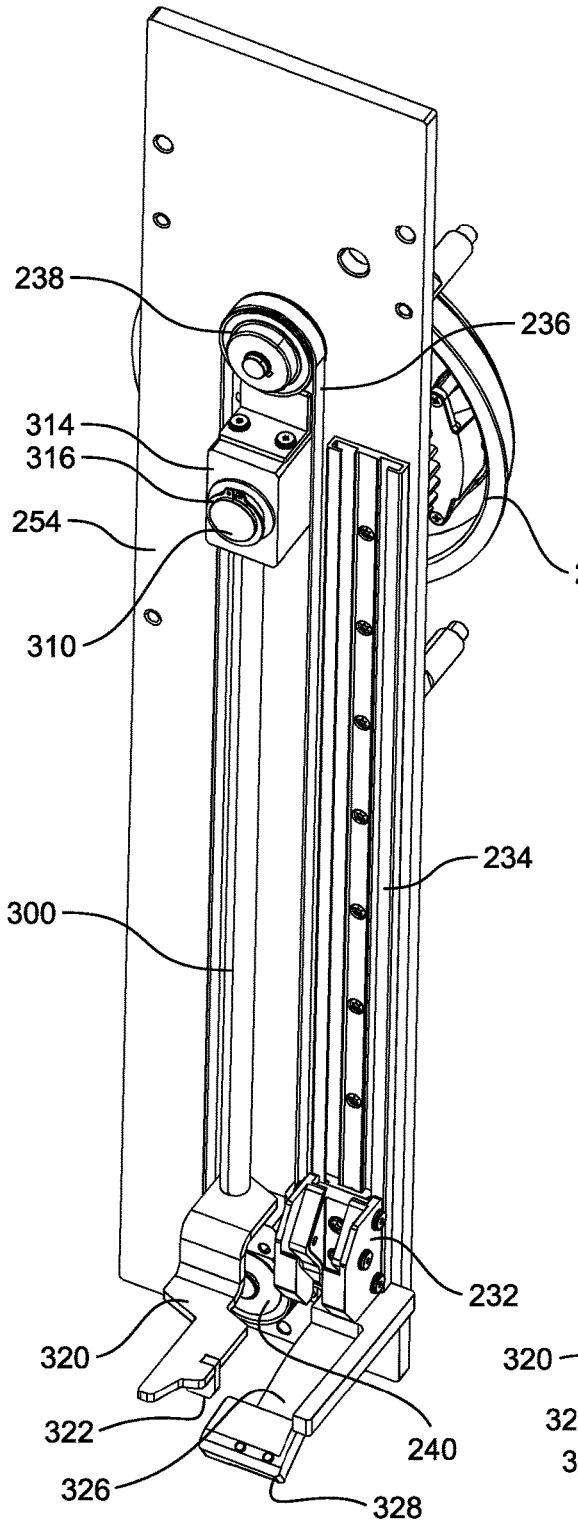
FIG. 35 shows a left rear perspective view of a weight selection mechanism and a first safety mechanism of the weight stack assembly of FIG. 23 removed from the housing and with a number of parts removed to show the internal details of the mechanisms and having a plate spring arranged in a bent position.
Figure 36:
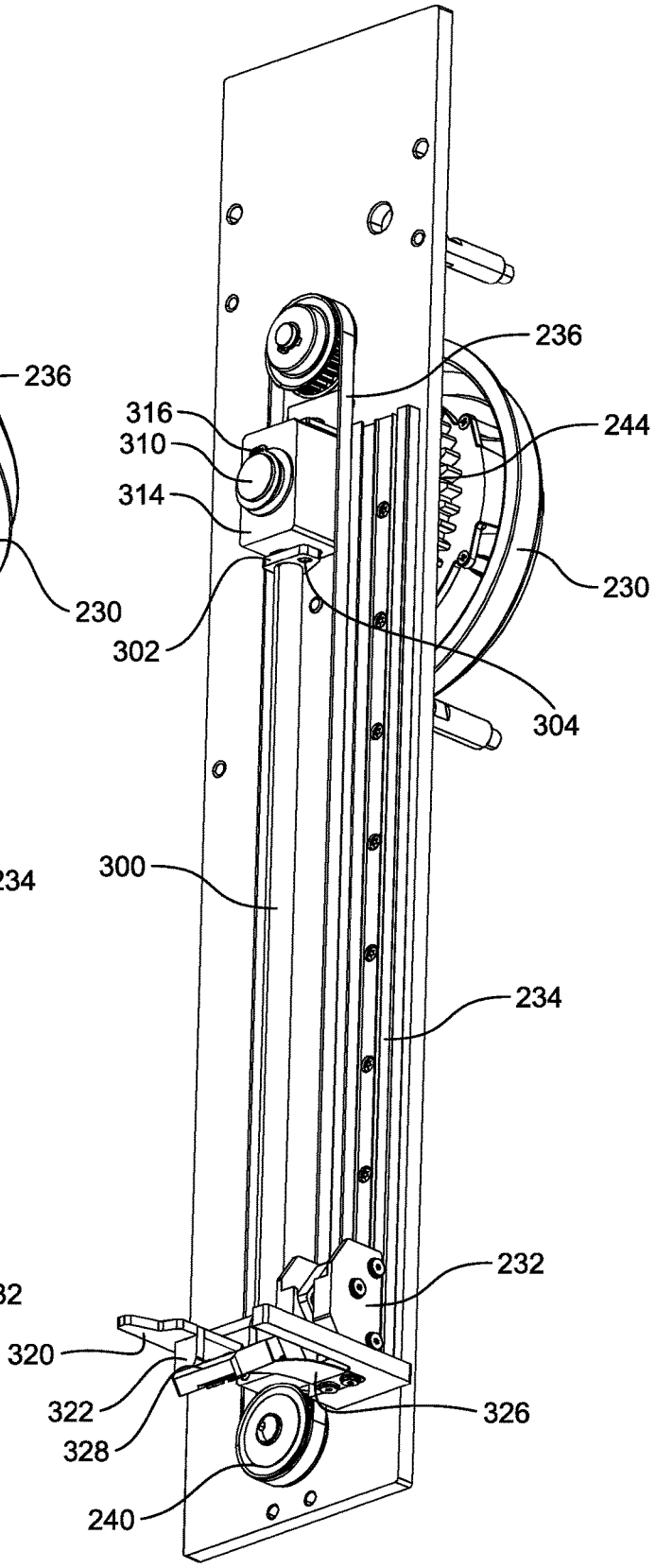
FIG. 36 shows a right rear perspective view of the weight selection mechanism and the first safety mechanism of the weight stack assembly of FIG. 23 removed from the housing and with a number of parts removed to show the internal details of the mechanism and depicting the plate spring in a bent position.
Figure 39:
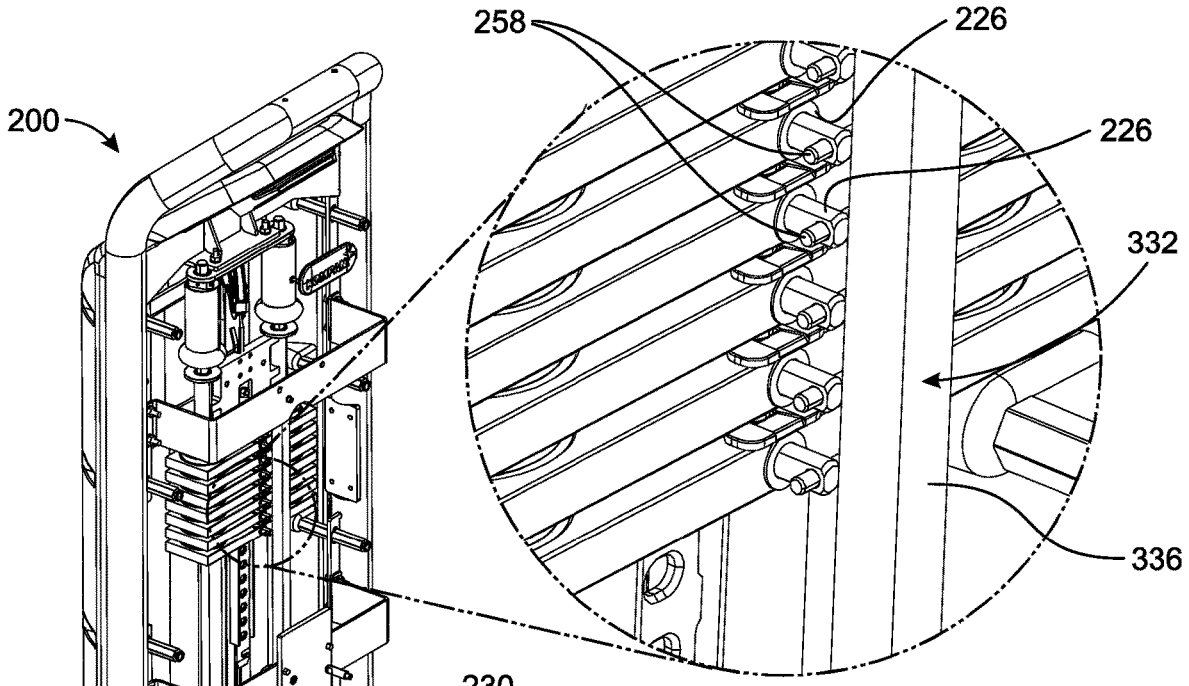
FIG. 39 shows an enlarged view of a portion of the weight stack assembly of FIG. 38 depicting an elongated flange that prevents an outward movement of the pins relative to the weight plates during up and down movement of the weight stack.
Figure 38:
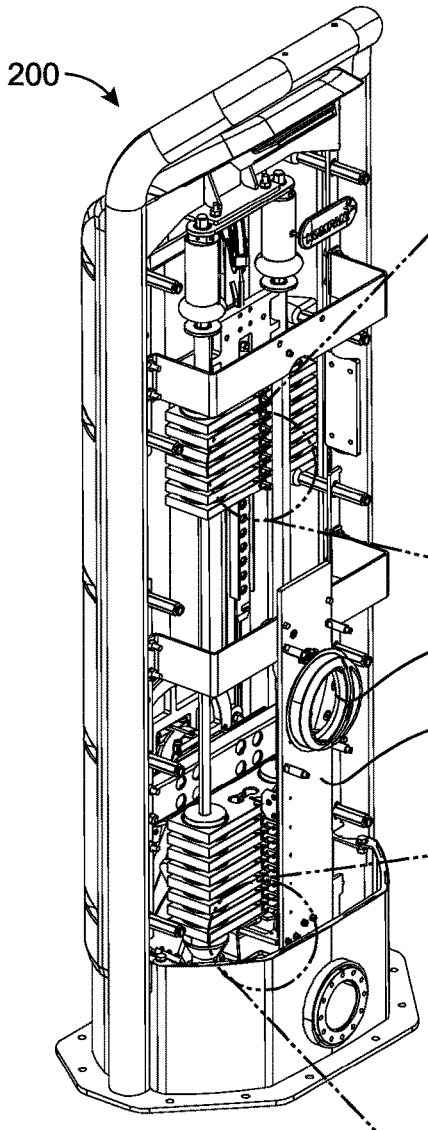
FIG. 38 shows a side front perspective view of the weight stack assembly of FIG. 23 with the housing and a number of parts removed to show the internal parts of the mechanism and with a number of the weight plates lifted up.

Another feature of the weigh stack assembly 200 is that an elongated flange 332 is arranged inside the housing 202 and in a forward portion of the housing 202 as shown in FIGS. 34 and 39. The elongated flange 332 prevents a disengagement of the pins 226 from the elongated rod member 210 during lifting of the weight stack. As shown in FIG., the elongated flange 332 incudes a lower tapered portion 334 and a straight portion 336 extending upwardly from the tapered portion 334. The tapered portion 334 enables an insertion of the pin 226 back into the elongated rod member 210 as the weight stack is lifted upwardly, and the straight portion 336 keeps the pin 226 inside the elongated rod 210 upon further lifting of the weight stack. As the weight stack is moved up and down by the user, one or more of the pins 226 may move outwardly due to vibrations or other forces acting on the mechanism by the motion of the user. Such a pin 226 will contact the tapered portion 334 during the upward movement of the weigh stack and will be pushed back inwardly as the pin 226 slides along the tapered portion 334 upon contacting the tapered portion 334. Further, such a pin 226 will remain in contact with the straight portion 336 during additional upward movement of the weight stack to prevent the movement of the pin 226 outwardly of the elongated rod member 210.

It is to be noted that the figures and the above description have shown the example embodiments in a simple and schematic manner. Many of the specific mechanical details have not been shown since the person skilled in the art should be familiar with these details and they would just unnecessarily complicate this description. For example, the specific materials used and the specific manufacturing procedures have not been described in detail since it is maintained that the person skilled in the art would be able to find suitable materials and suitable processes to manufacture the weight lifting machines according to the current invention.

Furthermore, the figures show additional features which the person skilled in the art will be able to understand. As such, they have not been described in detail herein.

The invention claimed is:

1. A weight lifting machine arrangement comprising:

a first weight lifting machine and a second weight lifting machine, wherein each of the first weight lifting machine and the second weight lifting machine comprises:

a. an adjustable weight assembly, and b. a user force input assembly, c. said adjustable weight assembly comprising:

i. a plurality of individual weights, ii. a weight displacement mechanism which displaces one or more of the plurality of individual weights in a direction against a resistive force, and iii. a weight selection mechanism arranged to selectively engage one or more of said plurality of individual weights with said weight displacement mechanism, d. said user force input assembly comprising:

i. a handle or other user force input device suitable for a user to apply force to, ii. and a horizontal bar connected to the handle or other user force input device, said horizontal bar being arranged to pivot about a horizontal axis, said horizontal bar being connected to the weight displacement mechanism such that motion of the handle or other user force input device results in motion of the weight displacement mechanism, wherein e. the adjustable weight assembly further comprises:

i. a housing which encloses the plurality of individual weights, the weight displacement mechanism and the weight selection mechanism inside the housing such that a user is prevented from coming into contact with any moving parts arranged in the housing, and ii. a displaceable selector handle arranged on an outer portion of the housing, said displaceable selector handle being arranged to operate the weight selection mechanism arranged inside the housing, and f. in that the horizontal bar is arranged outside the housing and engages with the weight displacement mechanism arranged inside the housing via an opening in the housing, and wherein a vertical distance from the ground to the horizontal bar of the first weight lifting machine is greater than the vertical distance from the ground to the horizontal bar of the second weight lifting machine.

2. The weight lifting machine arrangement according to claim 1, wherein the handle or other user force input device and the horizontal bar of at least one of the first or second weight lifting machine form a single unit where a positional relationship between the handle or other user force input device and the horizontal bar is constant.

3. The weight lifting machine arrangement according to claim 1, wherein, for at least one of the first or second weight lifting machine, the plurality of individual weights is in the form of a vertically arranged stack of weight plates and in that the weight displacement mechanism comprises a rotational to linear translation mechanism, said rotational to linear translation mechanism being connected between the horizontal bar and the plurality of individual weights, such that when the user force input assembly is moved by the user, the horizontal bar rotates and the weights move up or down, depending on the direction of motion of the user force input assembly.

4. The weight lifting machine arrangement according to claim 3, wherein, for at least one of the first or second weight lifting machine, each of the plurality of weight plates in the stack of weight plates is provided with a vertically arranged through-going hole in a top surface of the weight plates, in that the vertically arranged through-going holes of the plurality of weight plates are aligned along a vertical axis and in that the weight selection mechanism comprises a vertically arranged rod which is arranged to enter the vertically arranged through-going holes in the weight plates and in that each weight plate is provided with an engagement mechanism having two positions, an engaged position and a disengaged position where the weight plate is engaged with the vertically arranged rod in the engaged position and disengaged from the vertically arranged rod in the disengaged position.

5. The weight lifting machine arrangement according to claim 4, wherein, for at least one of the first or second weight lifting machine, the weight selection mechanism comprises a vertically displaceable trolley which moves along a vertical axis in response to the motion of the selector handle and in that the vertically displaceable trolley actuates the engagement mechanisms of the weight plates as the trolley passes the weight plates.

6. The weight lifting machine arrangement according to claim 5, wherein, for at least one of the first or second weight lifting machine, the weight selection mechanism comprises a plurality of pins, each pin being associated with one weight plate and being arranged displaceably in a hole in the weight plate, each of said pins having a first engaged position and a second disengaged position, where the pin in its engaged position is pushed into the weight plate such that it engages a hole in the vertically arranged rod and in the disengaged position, the pin is retracted in the weight plate so that it is not engaged with the vertically arranged rod.

7. The weight lifting machine arrangement according to claim 6, wherein, for at least one of the first or second weight lifting machine, the trolley pushes the pins into their engaged position when the trolley moves downwardly past the pin and pulls the pin into its disengaged position when the trolley moves upwardly past the pin.

8. The weight lifting machine arrangement according to claim 7, wherein, for at least one of the first or second weight lifting machine, the weight selection mechanism comprises a pin stabilization mechanism which keeps the pins below the trolley from moving inwardly.

9. The weight lifting machine arrangement according claim 1, wherein, for at least one of the first or second weight lifting machine the weight selection mechanism comprises a first safety mechanism for preventing adjustment of the weight selection mechanism when one or more of the plurality of weights are displaced away from their resting position and/or a second safety mechanism for preventing displacement of the weight displacement mechanism during operation of the weight selection mechanism.

10. The weight lifting machine arrangement according to claim 1, wherein the weight displacement mechanism of the first and second machines both comprise a first elongated flexible member, the first elongated flexible member in the form of a wire or a belt, connected to a lever arm which is pivoted by the horizontal bar.

11. The weight lifting machine arrangement according to claim 10, wherein the first elongated flexible member is arranged to drive a first pulley wheel attached to a frame of the weight lifting machine when the lever arm is pivoted.

12. The weight lifting machine arrangement according to claim 11, wherein the first pulley wheel is arranged to drive a second pulley wheel which is larger than the first pulley wheel.

13. The weight lifting machine arrangement according to claim 12, wherein the weight displacement mechanism further comprises a second elongated flexible member, the second elongated flexible member in the form of a wire or a belt, connecting the second pulley wheel and an elongated rod of the weight selection mechanism via a third pulley wheel arranged at an] upper portion of the housing.

14. The weight lifting machine arrangement according to claim 13, wherein the lever arm and/or the first pulley wheel and/or the second pulley wheel are pivotably fastened to a frame of the weight lifting machine via one or more brackets which is/are bolted to the frame of the weight lifting machine.

15. The weight lifting machine arrangement according to claim 14, wherein the first machine and the second machine, both have the same frame, each frame having mounting holes suitable for mounting the brackets of the lever arm, the first and/or the second pulley wheel in a first location and in a second different location.

16. The weight lifting machine arrangement according to claim 12, wherein the first and second flexible elongated members are both parts of the same elongated flexible member.

* * * * *